US011634795B2

(12) United States Patent
Shankar et al.

(10) Patent No.: US 11,634,795 B2
(45) Date of Patent: Apr. 25, 2023

(54) ALUMINIUM ALLOYS FOR STRUCTURAL AND NON-STRUCTURAL NEAR NET CASTING, AND METHODS FOR PRODUCING SAME

(71) Applicant: MCMASTER UNIVERSITY, Hamilton (CA)

(72) Inventors: Sumanth Shankar, Dundas (CA); Xiaochun Zeng, Hamilton (CA)

(73) Assignee: MCMASTER UNIVERSITY, Hamilton (CA)

( * ) Notice: Subject to any disclaimer, the term of this patent is extended or adjusted under 35 U.S.C. 154(b) by 223 days.

(21) Appl. No.: 16/464,530

(22) PCT Filed: Nov. 27, 2017

(86) PCT No.: PCT/CA2017/051420
§ 371 (c)(1),
(2) Date: May 28, 2019

(87) PCT Pub. No.: WO2018/094535
PCT Pub. Date: May 31, 2018

(65) Prior Publication Data

US 2019/0376166 A1 Dec. 12, 2019

Related U.S. Application Data

(60) Provisional application No. 62/426,822, filed on Nov. 28, 2016.

(51) Int. Cl.
*C22C 21/10* (2006.01)
*C22F 1/053* (2006.01)

(52) U.S. Cl.
CPC ..... *C22C 21/10* (2013.01); *C22F 1/053* (2013.01)

(58) Field of Classification Search
CPC ..... C22C 21/10; C22F 1/053; C22F 1/04
See application file for complete search history.

(56) References Cited

U.S. PATENT DOCUMENTS 3,637,441 A 1/1972 Lyle et al.
3,885,959 A 5/1975 Badia et al.
(Continued)

FOREIGN PATENT DOCUMENTS

CA 2035361 A1 8/1991
CA 2945341 A1 11/2015
(Continued)

OTHER PUBLICATIONS

International Search Report for PCT/CA2017/051420 dated Mar. 2, 2018, 5 pages.
ASTM E8/E8M-11a Standard Test Methods for Tension Testing of Metallic Materials, ASTM International, West Conshohocken, PA, 2011.
(Continued)

*Primary Examiner* — Robert S Jones, Jr.
*Assistant Examiner* — Jiangtian Xu
(74) *Attorney, Agent, or Firm* — Bereskin & Parr LLP/S.E.N.C.R.L., s.r.l.

(57) ABSTRACT

An aluminum alloy for near net shaped casting of structural components is disclosed. The alloy contains 2 to 10 wt. % Zn, 0.5 to 5 wt. % Mg, 0.5 to 5 wt. %) Fe, optionally Cu, Ti, Sr, Be, Zr, V, Cr, Sc, Na, Si, Mn, Mo, B, and Ni, with balance aluminum. The alloy may be subjected to heat treatment selected from the group consisting of solutionizing, incubation, aging, and two or more heat treatment steps.

18 Claims, 32 Drawing Sheets

(56) References Cited

U.S. PATENT DOCUMENTS

| | | | | |
|---|---|---|---|---|
| 4,193,822 | A * | 3/1980 | Adam | C22C 21/00 148/549 |
| 4,711,762 | A | 12/1987 | Vernom et al. | |
| 2002/0051695 | A1 | 5/2002 | Freiderich et al. | |
| 2007/0204937 | A1 | 9/2007 | Buerger et al. | |
| 2014/0261907 | A1 | 9/2014 | Wang et al. | |
| 2015/0144229 | A1 | 5/2015 | Ando et al. | |
| 2015/0218678 | A1 | 8/2015 | Kim et al. | |
| 2015/0283607 | A1 | 10/2015 | Yang et al. | |
| 2017/0113305 | A1* | 4/2017 | Ando | C22C 21/00 |

FOREIGN PATENT DOCUMENTS

| | | | |
|---|---|---|---|
| GB | 644776 | A | 10/1950 |
| JP | 1294841 | A | 11/1989 |
| KR | 20140025042 | A | 3/2014 |
| WO | WO2014030915 | A1 | 2/2014 |
| WO | 2015141193 | A1 | 9/2015 |

OTHER PUBLICATIONS

ASTM E466-15 Standard Practice for Conducting Force Controlled Constant Amplitude Axial Fatigue Tests of Metallic Materials, ASTM International, West Conshohocken, PA, 2015.

ASTM E606/E606M-12 Standard Test Method for Strain-Controlled Fatigue Testing, ASTM International, West Conshohocken, PA, 2012.

ASTM G65-04 Standard Test Method for Measuring Abrasion Using the Dry Sand/Rubber Wheel Apparatus, ASTM International, West Conshohocken, PA, 2004.

ASTM E23-16b Standard Test Methods for Notched Bar Impact Testing of Metallic Materials, ASTM International, West Conshohocken, PA, 2016.

Takuro Aoki et al., Microstructure and Mechanical Properties of D-SSF Processed Al—Zn—Mg Alloys with High Fe Content, Materials Science Forum, vols. 794-796, 2014, pp. 1109-1114.

Taylor, "The Effect of Iron in Al—Si Casting Alloys", Cooperative Research Centre for Cast Metals Manufacturing (CAST), The University of Queensland, Brisbane, Australia, Oct. 2004.

* cited by examiner

Figure 2

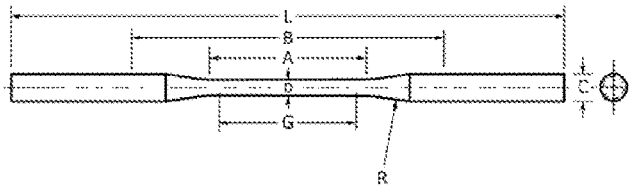

| Dimensions, mm [in.] | |
|---|---|
| *G*—Gauge length | 50 ± 0.1 [2.000 ± 0.005] |
| *D*—Diameter (see Note) | 6.4 ± 0.1 [0.250 ± 0.005] |
| *R*—Radius of fillet, min | 75 [3] |
| *A*—Length of reduced parallel section, min | 60 [2.25] |
| *L*—Overall length, min | 230 [9] |
| *B*—Distance between grips, min | 119 [4.5] |
| *C*—Diameter of end section, approximate | 10 [0.375] |

NOTE 1—The reduced parallel section may have a gradual taper from the end toward the center, with the ends not more than 0.1 mm [0.005 in.] larger in diameter than the center.

Standard Tension Test Specimens for Die Castings

Dimensions, mm [in.]

For Test Specimens with Gauge Length Four times the Diameter [E8]

| | Standard Specimen | Small-Size Specimens Proportional to Standard | | | |
|---|---|---|---|---|---|
| | Specimen 1 | Specimen 2 | Specimen 3 | Specimen 4 | Specimen 5 |
| *G*—Gauge length | 50.0 ± 0.1 [2.000 ± 0.005] | 36.0 ± 0.1 [1.400 ± 0.005] | 24.0 ± 0.1 [1.000 ± 0.005] | 16.0 ± 0.1 [0.640 ± 0.005] | 10.0 ±0.1 [0.450 ± 0.005] |
| *D*—Diameter (Note 1) | 12.5 ± 0.2 [0.500 ± 0.010] | 9.0 ±0.1 [0.350 ± 0.007] | 6.0 ± 0.1 [0.250 ± 0.005] | 4.0 ± 0.1 [0.160 ± 0.003] | 2.5 ± 0.1 [0.113 ± 0.002] |
| *R*—Radius of fillet, min | 10 [0.375] | 8 [0.25] | 6 [0.188] | 4 [0.156] | 2 [0.094] |
| *A*—Length of reduced section, min (Note 2) | 56 [2.25] | 45 [1.75] | 30 [1.25] | 20 [0.75] | 16 [0.625] |

ASTM G65 Standard Test Method for Measuring
Abrasion Using the Dry Sand/Rubber Wheel Apparatus

ALUMINIUM ALLOYS FOR STRUCTURAL AND NON-STRUCTURAL NEAR NET CASTING, AND METHODS FOR PRODUCING SAME

FIELD

The present invention relates to the field of aluminium alloys. The present invention is an aluminium alloy utilizing zinc, magnesium, and iron as primary alloying elements, and copper, manganese, titanium, boron, zirconium, vanadium, scandium, chromium, strontium, sodium, molybdenum, silicon, nickel and beryllium as possible minor alloying elements. More particularly, the invention relates to an aluminium-based alloy for near net shape casting of structural and non-structural components. Additionally, when cast this aluminium alloy has reasonable corrosion resistance.

BACKGROUND

Aluminium alloys are widely used in structural components and manufacturing where corrosion resistance and light weight are required, without significantly compromising strength. Many formulations of aluminium alloy exist, all with different properties depending on the formulation of the Al alloy, and the methods used to produce the alloy. Depending on the formulation, certain trade-offs can exist, such as sacrificing toughness for increased strength. Cost and ease of production are also factors when considering the type of aluminium alloy.

SUMMARY OF THE INVENTION

Aluminium alloys have been developed to enable structural and non-structural near-net shaped components for automotive and non-automotive industrial application. Any gravity or pressure assisted metal die or sand mould casting process including but not limited to High Pressure Die Casting (HPDC) could be used to manufacture the alloy into near-net shaped components. The manufacturing method may include the assistance of vacuum during the casting process. All components made from the family of alloys proposed herein may be heat-treated to several combinations of temper for improvement in tensile strength, ductility and resistance to corrosion during service.

This new aluminium alloy provides a formulation that can be used to manufacture components that have high uniaxial tensile properties and fatigue properties, among other material advantages. Compared to the best existing commercial aluminium alloys, this new aluminium allow may be able to attain up to a 200% improvement in strength and elongation when compared to other alloys having similar heat treatment temper conditions. Rather than focusing solely on maximizing singular properties such as strength, while minimizing the deteriorating effect on other properties such as toughness, the present invention considers improving the manufacturing process, while at the same time increasing several key material properties. For example, in manufacturing this aluminium alloy there is a reduced incident of die soldering and improved life of metal mould cavities, as well as improved fluidity and castability. Furthermore, there is improved recyclability and re-claimability of the alloy. In addition, this alloy specifies parameters for a greater number of elements, and allows for a greater range in tolerance for elements used.

This new alloy has been tested using a variety of compositional variations for the alloy. These have been evaluated for metal and sand mould casting processes, such as high pressure die casting, permanent mould casting (gravity assisted) and sand mould casting, all with positive results.

The present invention is an aluminium alloy utilizing zinc, magnesium, and iron as primary alloying elements, and copper, manganese, titanium, boron, zirconium, vanadium, scandium, chromium, strontium, sodium, molybdenum, silicon, nickel and beryllium as possible minor alloying elements.

More particularly, an aluminium based alloy with zinc, magnesium and iron as primary alloying elements for near net shaped casting of structural components consists of one or more of the following essential elements along with Al:

2 to 10 percentage by weight zinc
0.5 to 5 percentage by weight magnesium
0.5 to 5 percentage by weight iron
0 to 4 percentage by weight copper
0 to 0.5 percentage by weight titanium
0 to 0.1 percentage by weight strontium
0 to 0.2 percentage by weight beryllium
0 to 0.5 percentage by weight zirconium
0 to 0.5 percentage by weight vanadium
0 to 0.5 percentage by weight chromium
0 to 0.5 percentage by weight scandium
0 to 0.1 percentage by weight sodium
0 to 0.5 percentage by weight silicon
0 to 1 percentage by weight manganese
0 to 5 percentage by weight nickel
0 to 0.5 percentage by weight boron
0 to 1 percentage by weight molybdenum Remaining percentage (66.6 to 96) by weight is aluminium The alloy may be cast into near net shaped components using a pressure assisted casting process such as High Pressure Die Casting.

Degassing with an argon or nitrogen gas purge in the liquid metal may also be employed to clean the molten alloy.

The use of vacuum may also be used in the die casting process to reduce entrapped gas in the casting resulting in improved tensile strength and ductility of the cast component.

The components manufactured by the casting process either with or without the assistance of vacuum may be heat treated extensively to achieve a variety of tempers. The main strengthening mechanism during heat treatment is one or more of solid solution strengthening and strengthening from precipitation in the primary aluminium phase through solid-state phase transformation. A list of heat treated tempers that the component could be subjected to successfully without any defects is presented below:

Fx—As-Cast temper F with natural ageing (incubation) at room temperature for x days.

T4-y—Solutionizing treatment T4 with natural ageing (incubation) at room temperature. y is an numeric identifier to represent the unique details of the T4 heat treatment used for each component.

T5—Artificial ageing at high temperature of samples in Fx temper.

T6-y—Near Peak artificial ageing process carried out by thermal assistance at high temperature. y is an numeric identifier to represent the unique details of the T6 heat treatment used for each component.

T7-y—Artificial ageing process at high temperature for durations that render the components well past the time required for peak strength at any given temperature. y is an numeric identifier to represent the unique details of the T7 heat treatment used for each component.

A variety of exemplar components were cast using this alloy in pressure assisted casting processes. These included: Small Scale Test Samples (SSTS); Large Scale Test Samples (LSTS); and a Side Impact Door Beam (SIB).

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment and which will now be briefly described.

FIG. 2 shows the dimensions of the small tensile test specimen demarcated as B in FIG. 1. The component adheres to the ASTM E8/E8-11 standard for tensile test specimen.

FIG. 23 shows the dimensions of tensile test flat specimen shown in

DETAILED DESCRIPTION

I. Definitions

Figure 1:
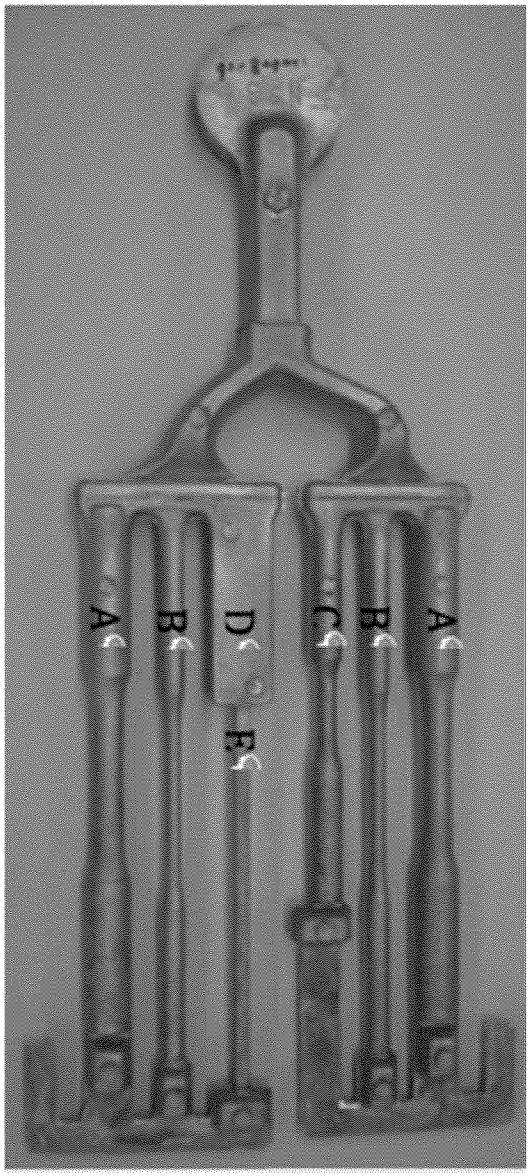
FIG. 1 shows a typical casting of the small scale test specimen component consisting of: A—standard thick tensile test specimen; B—standard thin tensile test specimen; C—standard fatigue test specimen; D—standard wear test specimen and E—standard impact strength test specimen.
Figure 3:
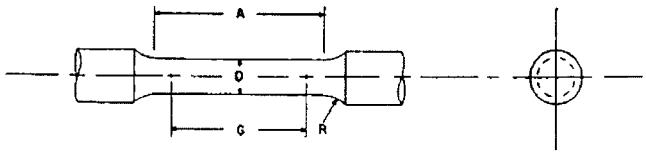
FIG. 3 shows the dimensions of the large tensile test specimen demarcated as A in FIG. 1. The component adheres to the ASTM E8/E8-11 standard for tensile test specimen.
Figure 4:
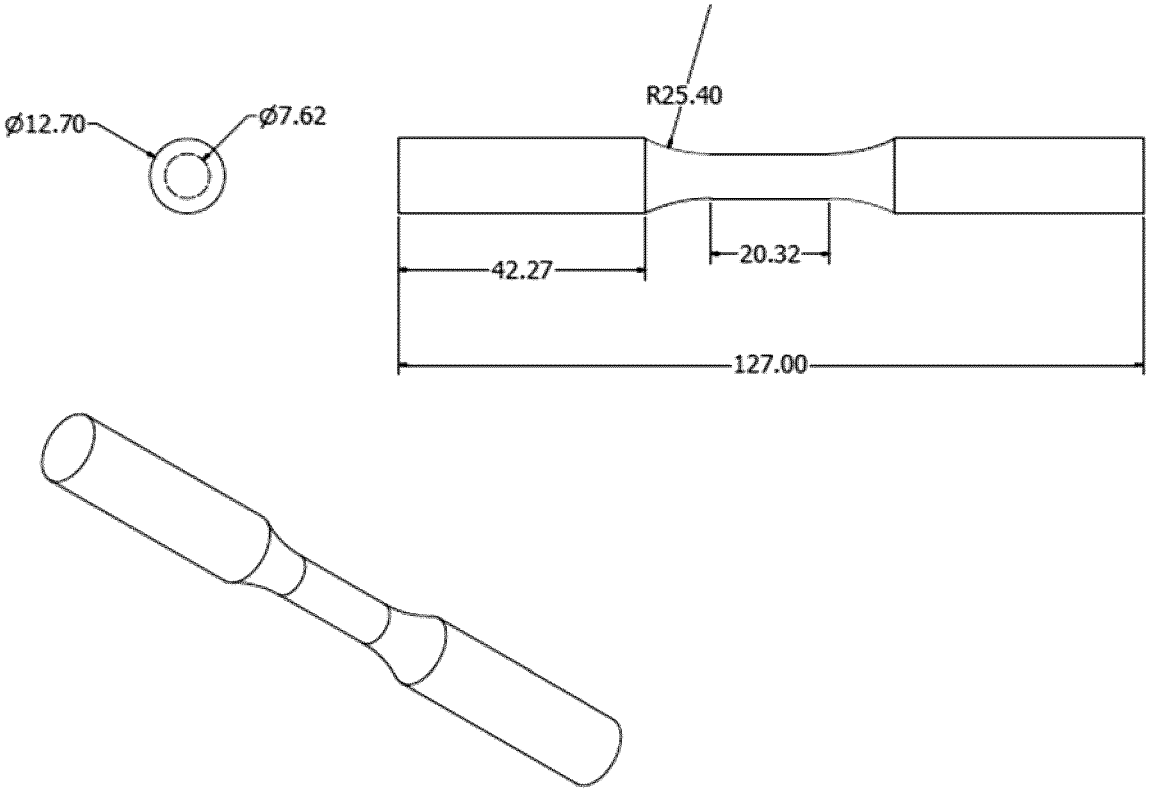
FIG. 4 shows the dimensions in millimeters of the fatigue test specimen demarcated as C in FIG. 1. The component adheres to the ASTM E466 & E606 standard for fatigue test specimen (Stress and Strain controlled).
Figure 5:
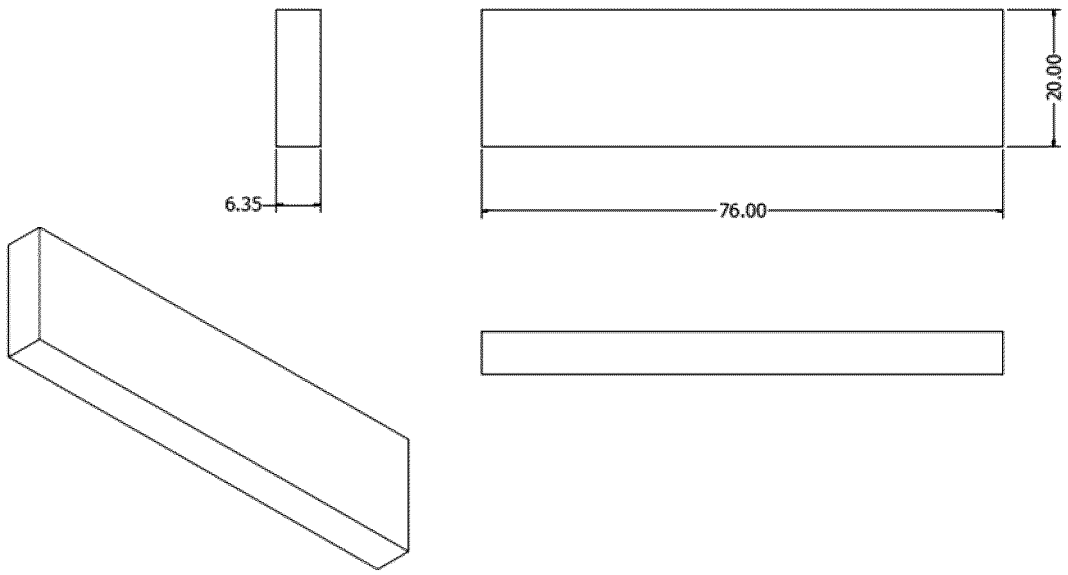
FIG. 5 shows the dimensions in millimeters of the wear test specimen demarcated as D in FIG. 1. The component adheres to the ASTM G65-04 standard for wear test specimen.
Figure 6:
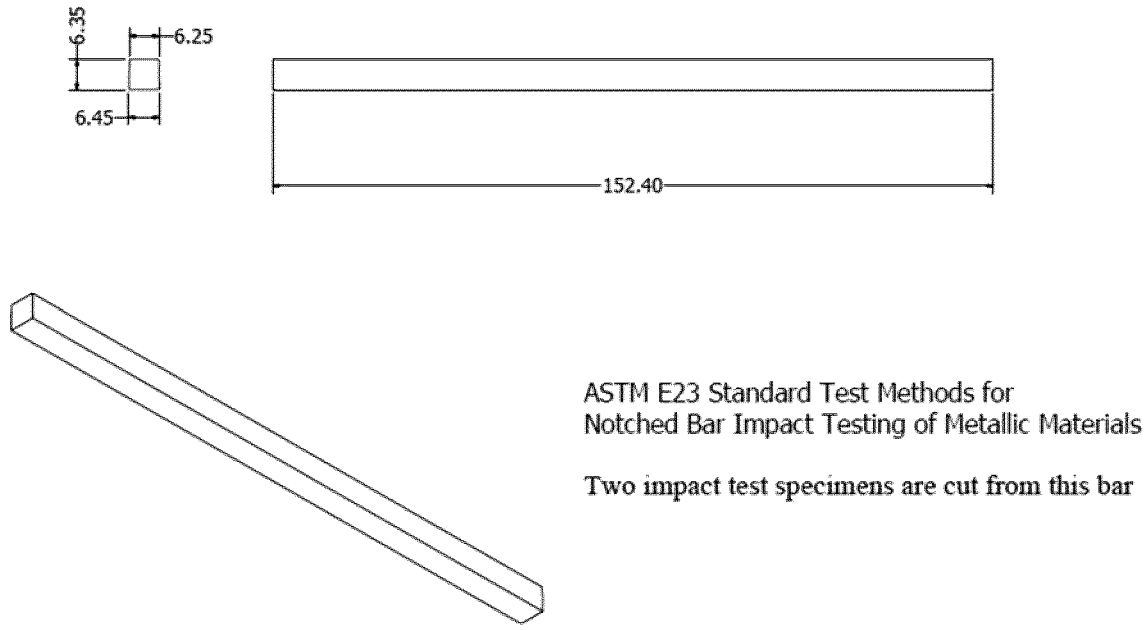
FIG. 6 shows the dimensions in millimeters of the impact strength test specimen demarcated as E in FIG. 1. The component adheres to the ASTM E23 standard for impact strength test specimen.

Unless otherwise indicated, the definitions and embodiments described in this and other sections are intended to be applicable to all embodiments and aspects of the present application herein described for which they are suitable as would be understood by a person skilled in the art.

In understanding the scope of the present application, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. The term "consisting" and its derivatives, as used herein, are intended to be closed terms that specify the presence of the stated features, elements, components, groups, integers, and/or steps, but exclude the presence of other unstated features, elements, components, groups, integers and/or steps. The term "consisting essentially of", as used herein, is intended to specify the presence of the stated features, elements, components, groups, integers, and/or steps as well as those that do not materially affect the basic and novel characteristic(s) of features, elements, components, groups, integers, and/or steps.

Terms of degree such as "substantially", "about" and "approximately" as used herein mean a reasonable amount of deviation of the modified term such that the end result is not significantly changed. These terms of degree should be construed as including a deviation of at least ±5% of the modified term if this deviation would not negate the meaning of the word it modifies.

As used in this application, the singular forms "a", "an" and "the" include plural references unless the content clearly dictates otherwise. For example, an embodiment including "an alloy" should be understood to present certain aspects with one substance or two or more additional substances.

In embodiments comprising an "additional" or "second" component, such as an additional or second element, the second component as used herein is chemically different from the other components or first component. A "third" component is different from the other, first, and second components, and further enumerated or "additional" components are similarly different.

The term "and/or" as used herein means that the listed items are present, or used, individually or in combination. In effect, this term means that "at least one of" or "one or more" of the listed items is used or present.

Aluminium alloys have been developed to enable structural and non-structural near-net shaped components for automotive and non-automotive industrial application. Any pressure assisted metal die casting process including but not limited to High Pressure Die Casting (HPDC) could be used to manufacture the alloy into near-net shaped components. The manufacturing method may include the assistance of vacuum during the casting process. All components made from the family of alloys proposed herein may be heat-treated to several combinations of temper for improvement in tensile strength, ductility and resistance to corrosion during service.

This new aluminium alloy provides a formulation that can be used to manufacture components that have high uniaxial tensile properties and fatigue properties, among other material advantages. Compared to the best existing commercial aluminium alloys, this new aluminium allow may be able to attain up to a 200% improvement in strength and elongation when compared to other alloys having similar heat treatment temper conditions. Rather than focusing solely on maximizing singular properties such as strength, while minimizing the deteriorating effect on other properties such as toughness, the present invention considers improving the manufacturing process, while at the same time increasing several key material properties. For example, in manufacturing this aluminium alloy there is a reduced incident of die soldering and improved life of metal mould cavities, as well as improved fluidity and castability. Furthermore, there is improved recyclability and re-claimability of the alloy. In addition, this alloy specifies parameters for a greater number of elements, and allows for a greater range in tolerance for elements used.

This new alloy has been tested using a variety of compositional variations for the alloy. These have been evaluated for metal and sand mould casting processes, such as high pressure die casting, permanent mould casting (gravity assisted) and sand mould casting, all with positive results.

The present invention is an aluminium alloy utilizing zinc, magnesium, and iron as primary alloying elements, and copper, manganese, titanium, boron, zirconium, vanadium, scandium, chromium, strontium, sodium, molybdenum, silicon, nickel and beryllium as possible minor alloying elements.

More particularly, an aluminium based alloy with zinc, magnesium and iron as primary alloying elements for near net shaped casting of structural components consists of one or more of the following essential elements along with Al:

2 to 10 percentage by weight zinc
0.5 to 5 percentage by weight magnesium
0.5 to 5 percentage by weight iron
0 to 4 percentage by weight copper
0 to 0.5 percentage by weight titanium
0 to 0.1 percentage by weight strontium
0 to 0.2 percentage by weight beryllium
0 to 0.5 percentage by weight zirconium
0 to 0.5 percentage by weight vanadium
0 to 0.5 percentage by weight chromium
0 to 0.5 percentage by weight scandium
0 to 0.1 percentage by weight sodium
0 to 0.5 percentage by weight silicon
0 to 1 percentage by weight manganese
0 to 5 percentage by weight nickel
0 to 0.5 percentage by weight boron
0 to 1 percentage by weight molybdenum Remaining percentage (66.6 to 96) by weight is aluminium The alloy may be cast into near net shaped components using a pressure assisted casting process such as High Pressure Die Casting.

Degassing with an argon or nitrogen gas purge in the liquid metal may also be employed to clean the molten alloy.

The use of vacuum may also be used in the die casting process to reduce entrapped gas in the casting resulting in improved tensile strength and ductility of the cast component.

The components manufactured by the casting process either with or without the assistance of vacuum may be heat treated extensively to achieve a variety of tempers. The main strengthening mechanism during heat treatment is one or more of solid solution strengthening and strengthening from precipitation in the primary aluminium phase through solid-state phase transformation. A list of heat treated tempers that the component could be subjected to successfully without any defects is presented below:

Fx—As-Cast temper F with natural ageing (incubation) at room temperature for x days.

T4-y—Solutionizing treatment T4 with natural ageing (incubation) at room temperature. y is an numeric identifier to represent the unique details of the T4 heat treatment used for each component.

T5—Artificial ageing at high temperature of samples in Fx temper.

T6-y—Near Peak artificial ageing process carried out by thermal assistance at high temperature. y is an numeric identifier to represent the unique details of the T6 heat treatment used for each component.

T7-y—Artificial ageing process at high temperature for durations that render the components well past the time required for peak strength at any given temperature. y is an numeric identifier to represent the unique details of the T7 heat treatment used for each component.

A variety of exemplar components were cast using this alloy in pressure assisted casting processes. These included: Small Scale Test Samples (SSTS); Large Scale Test Samples (LSTS); and a Side Impact Door Beam (SIB).

II. Examples

The following non-limiting examples are illustrative of the present application:

One embodiment of the alloy consists of casting a thin walled part with composition of Al containing: 5 wt. % Zn; 2 wt. % Mg; 0.35 wt. % Cu; and, 1.5 wt. % Fe. The casting process is high pressure die casting without vacuum assistance with the final part having a yield strength, ultimate tensile strength and elongation of 200 MPa, 315 MPa and 3.80% respectively in the as-cast state with 21 days of natural ageing.

Another embodiment of the alloy consists of casting a LSTS with composition of Al-5 wt. % Zn-2 wt. % Mg-1.5 wt. % Fe. The casting process is high pressure die casting with vacuum assistance with the final part having a yield strength, ultimate tensile strength and elongation of 201 MPa, 312 MPa and 4.63% respectively in the as-cast state.

Heat treatment (any combination of solution only, incubation only, age only, no treatment or two or more heat treatment steps together) methods could include one or more of the following:

a) One Step Solutionizing: 460C for 3.5 hr to 24 hr with water quench
b) Two Step Solutionizing: 450C for 12-22 hr+5-30 C/h to 475-500C+475-500C for 4-7 hr with water quench
c) Incubation between solution and age: 1-24 hr at room temperature
d) Age (one step): 120-170C for 1-24 hr
e) Age (two step): 120-170C for 1-24 hr+120-170C for 1-24 hr Small-Scale Test Specimen (SSTS)

Alloy Compositions

The following alloy compositions were used in the manufacturing of the small-scale test specimen (SSTS) component.

TABLE 1

The list of typical alloy composition used to cast the SSTS component

| Alloy | Zn | Mg | Cu | Fe | Si | Mn | Zr | Ni | Al |
|---|---|---|---|---|---|---|---|---|---|
| | Percentage by Weight | | | | | | | | |
| SSTS #1 | 6.02 | 2.24 | 0.07 | 1.67 | 0 | 0.02 | 0 | 0 | Bal. |
| SSTS #2 | 6.17 | 2.22 | 0.07 | 1.83 | 0 | 0.02 | 0 | 0 | Bal. |
| SSTS #3 | 5.90 | 2.21 | 0.07 | 1.75 | 0 | 0.02 | 0 | 0 | Bal. |
| SSTS #4 | 5.56 | 2.08 | 0.07 | 3.78 | 0 | 0.03 | 0 | 0 | Bal. |
| SSTS #5 | 6.86 | 2.22 | 0.08 | 2.37 | 0 | 0.19 | 0 | 0 | Bal. |
| SSTS #6 | 5.92 | 2.15 | 0.38 | 1.62 | 0 | 0.24 | 0 | 0 | Bal. |
| SSTS #7 | 4.74 | 2.1 | 0.05 | 1.56 | 0 | 0.02 | 0 | 0 | Bal. |
| SSTS #8 HD2 (comparative example alloy) | 2.17 | 0.082 | 2.64 | 0.97 | 10.13 | 0.21 | 0.013 | 0.097 | Bal |
| SSTS Silafont 36 #9 (comparative example alloy) | 0.10 | 0.16 | 0.03 | 0.15 | 10 | 0.51 | 0 | 0 | Bal. |

Component

The FIG. 1 shows the photograph of a typical SSTS component. The details of each of the five (5) types of test specimen in the component shown in FIG. 1 is elaborated in FIG. 2 to FIG. 6.

Casting Process

The Table 2 presents the general details of the casting process used to manufacture the SSTS component shown in FIG. 1.

TABLE 2

The casting process used to manufacture the SSTS component shown in FIG. 1.

| Item | Description |
|---|---|
| Casting Machine | 600 Tons High Pressure Die Casting Machine |
| Die Tool material | H13 tool steel |
| Metal cleanliness | Degassing with Argon gas injected using a rotary degassing unit |

TABLE 2-continued

| The casting process used to manufacture the SSTS component shown in FIG. 1. | |
|---|---|
| Item | Description |
| Metal temperature | 700° C. to 735° C. |
| Vacuum | No Vacuum Assist |

Heat Treatment

The various heat treatment tempers that the SSTS was subjected to are listed in Table 3.

| | Description | | | |
|---|---|---|---|---|
| Heat Treatment Temper | Incubation | Solutionizing | Incubation after solutionizing | Artificial high temperature ageing |
| Fx | x day(s) at room temperature | N/A | N/A | N/A |
| T4 | N/A | 460° C. for 24 h | N/A | N/A |
| T6-1 | N/A | 460° C. for 24 h | 24 h | 120° C. for 2 h, 160° C. for 1 h |
| T6-2 | N/A | 460° C. for 24 h | 24 h | 120° C. for 2 h, 160° C. for 2 h |
| T6-3 | N/A | 460° C. for 24 h | 24 h | 120° C. for 2 h, 160° C. for 3 h |

Mechanical Properties

The Table 4 shows the typical mean mechanical properties obtained from uniaxial tensile tests carried out on the SSTS component at various heat treatment tempers.

TABLE 4

| The various heat treatment that the SSTS components were subjected to after being cast and prior to evaluation of mechanical properties. | | | | |
|---|---|---|---|---|
| Alloy | Heat Treatment Temper | Ultimate Tensile Strength (MPa) | 0.2% Proof Stress (MPa) | Elongation to Fracture (percentage Increase in gauge length) |
| SSTS #1 | $F_{11}$ | 328 | 228 | 4.37 |
| SSTS #2 | $F_{12}$ | 333 | 232 | 4.46 |
| SSTS #3 | $F_{13}$ | 341 | 233 | 4.93 |
| SSTS #4 | $F_{12}$ | 340 | 238 | 4.32 |
| SSTS #5 | $F_{14}$ | 344 | 253 | 3.35 |
| SSTS #6 | $F_{13}$ | 349 | 240 | 4.32 |
| SSTS #7 | $F_{13}$ | 330 | 197 | 7.42 |
| SSTS #8 (comparative example alloy) | $F_{13}$ | 302 | 145 | 2.97 |
| SSTS #9 (comparative example alloy) | $F_{13}$ | 261 | 123 | 6.26 |
| SSTS #4 | T4 | 387 | 276 | 4.79 |
| SSTS #5 | T4 | 400 | 299 | 3.91 |
| SSTS #6 | T4 | 410 | 286 | 5.96 |
| SSTS #7 | T4 | 394 | 238 | 9.98 |
| SSTS #4 | T6-1 | 481 | 439 | 2.07 |
| SSTS #4 | T6-2 | 483 | 451 | 1.51 |
| SSTS #4 | T6-3 | 483 | 458 | 1.26 |
| SSTS #5 | T6-1 | 510 | 474 | 1.54 |
| SSTS #5 | T6-2 | 543 | 503 | 1.79 |
| SSTS #5 | T6-3 | 515 | 498 | 1.11 |
| SSTS #6 | T6-2 | 512 | 464 | 1.94 |
| SSTS #6 | T6-3 | 511 | 468 | 1.70 |
| SSTS #7 | T6-1 | 412 | 348 | 4.41 |

TABLE 4-continued

| The various heat treatment that the SSTS components were subjected to after being cast and prior to evaluation of mechanical properties. | | | | |
|---|---|---|---|---|
| Alloy | Heat Treatment Temper | Ultimate Tensile Strength (MPa) | 0.2% Proof Stress (MPa) | Elongation to Fracture (percentage Increase in gauge length) |
| SSTS #7 | T6-2 | 436 | 396 | 2.52 |
| SSTS #7 | T6-3 | 442 | 404 | 2.63 |

Microstructure

Figure 7:
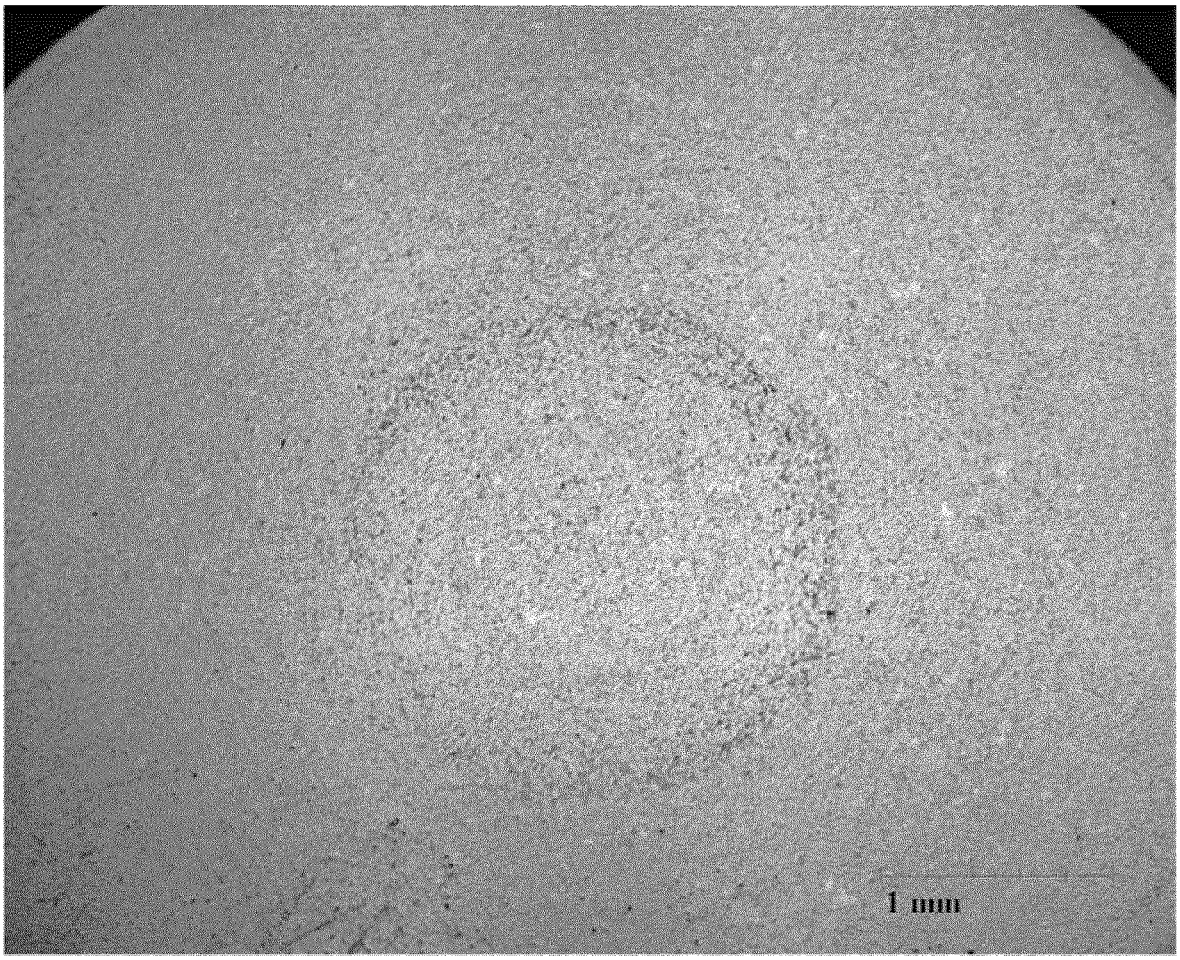
FIG. 7 shows a typical composite microstructure image obtained from a light optical microscope showing the entire cross-section of the gauge section of a thin tensile specimen in from the SSTS component. This image is from a specimen in F temper.
Figure 8:
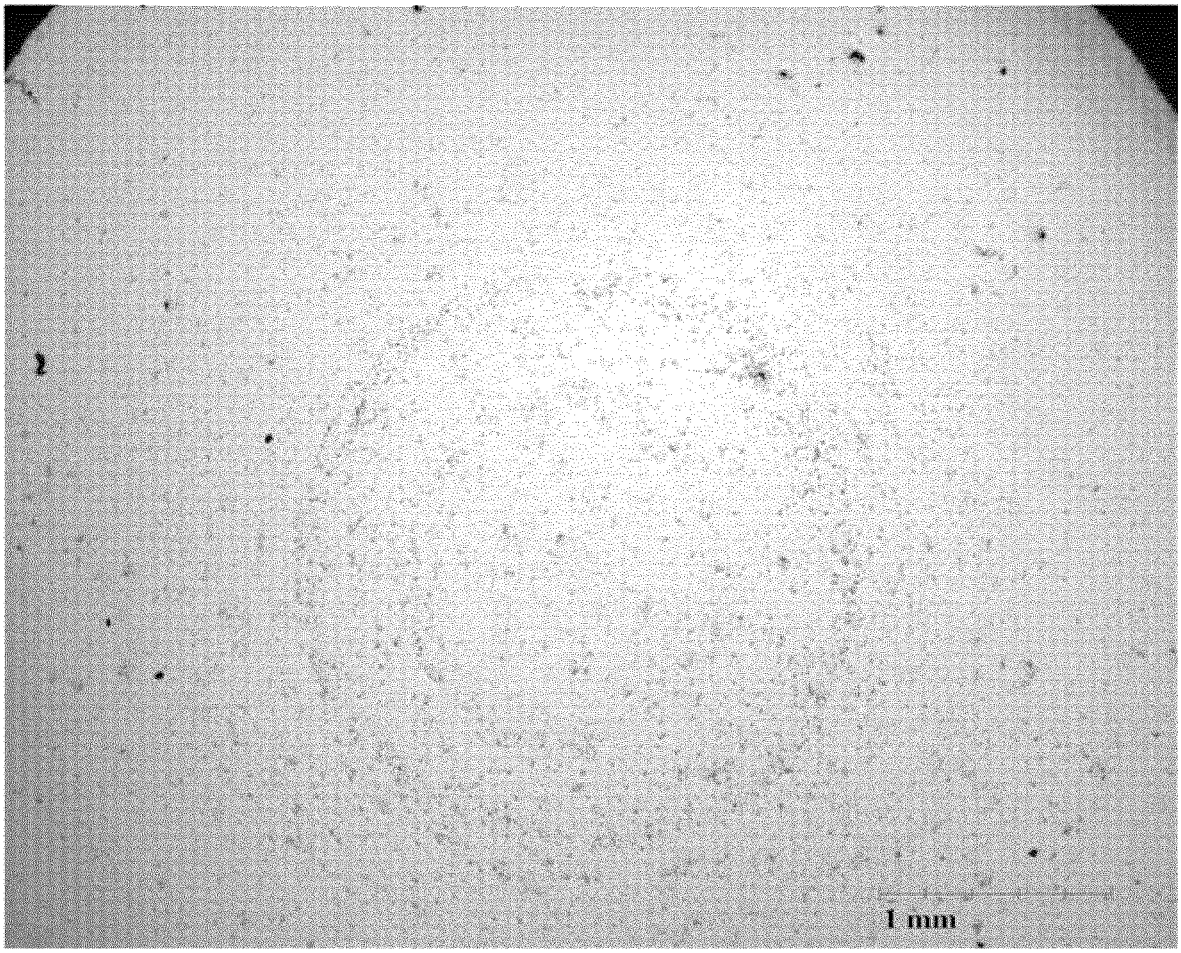
FIG. 8 shows a typical composite microstructure image obtained from a light optical microscope showing the entire cross-section of the gauge section of a thin tensile specimen in from the SSTS component. This image is from a specimen in T4 temper.
Figure 9:
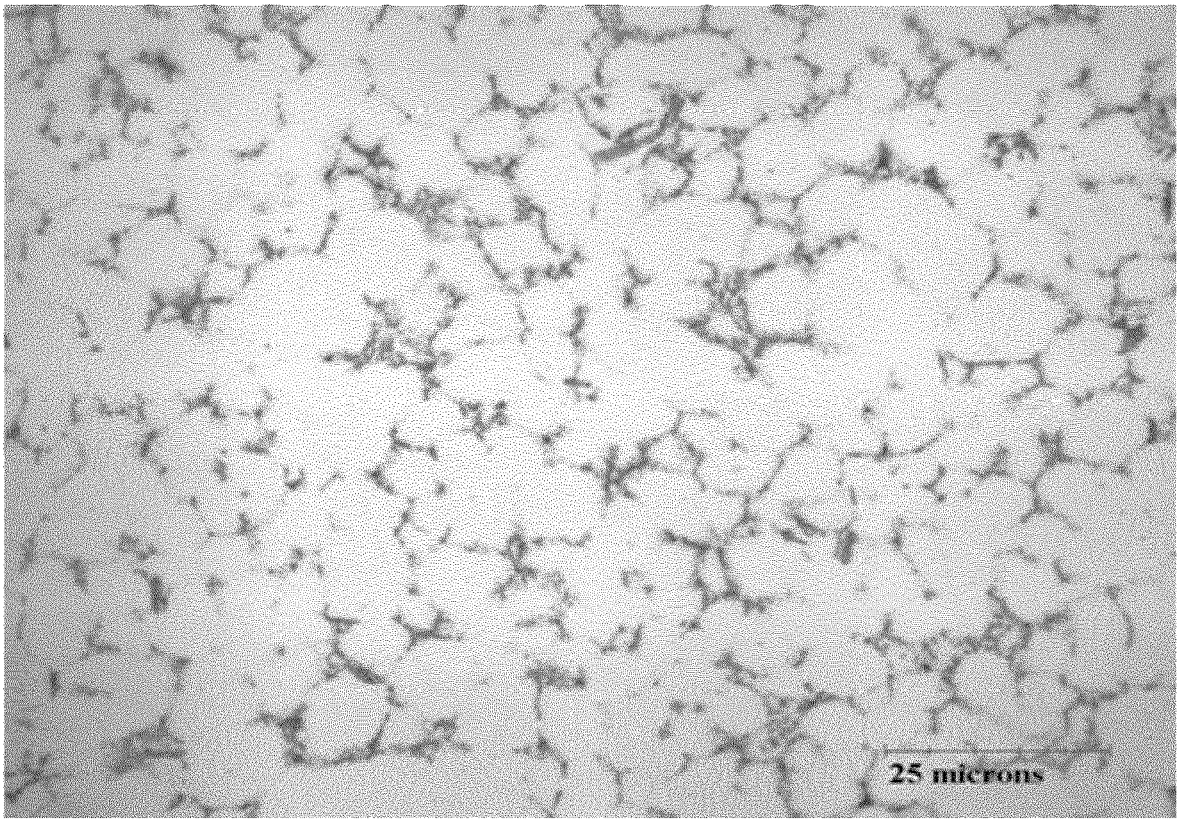
FIG. 9 shows a typical high magnification microstructure image obtained from a light optical microscope showing the primary aluminium phase in light shade and the secondary phases in darker shades. This image is from a specimen in F temper.

Typical microstructure images for the SSTS casting are shown for selected alloys in FIGS. 7-9.

Salient Features

None of the alloys shown in Table 1 exhibited any die soldering or die sticking tendencies on to the H13 tool steel material of the die.

The H13 tool steel die material did not exhibit any tendencies for heat checking when used with any of the alloys shown in Table 1.

All the castings of SSTS component were of acceptable integrity and quality as per conventional commercial casting industry wisdom; with no observable visual defects, filling issues or mis-runs.

Large-Scale Test Specimen (LSTS)

Alloy Compositions

The following alloy compositions were used in the manufacturing of the large-scale test specimen (LSTS) component.

TABLE 5

| The list of typical alloy composition used to cast the LSTS component | | | | | | | | | | |
|---|---|---|---|---|---|---|---|---|---|---|
| Alloy | Zn | Mg | Cu | Fe | Si | Ti | Zr | V | Mn | Al |
| | Percentage by Weight | | | | | | | | | |
| LSTS #1 | 5.2 | 2.0 | 0 | 1.5 | 0.04 | 0 | 0 | 0 | 0 | Bal. |
| LSTS #2 | 5.0 | 2.0 | 0.8 | 1.6 | 0.035 | 0 | 0 | 0 | 0 | Bal. |
| LSTS #3 | 5.16 | 1.91 | 0 | 1.53 | 0 | 0.10 | 0 | 0 | 0 | Bal. |
| LSTS #4 | 5.21 | 1.55 | 0 | 1.02 | 0 | 0.12 | 0 | 0 | 0 | Bal. |
| LSTS #5 | 5.19 | 1.54 | 0 | 1.04 | 0 | 0.15 | 0.13 | 0.057 | 0 | Bal. |

Component

Figure 10:
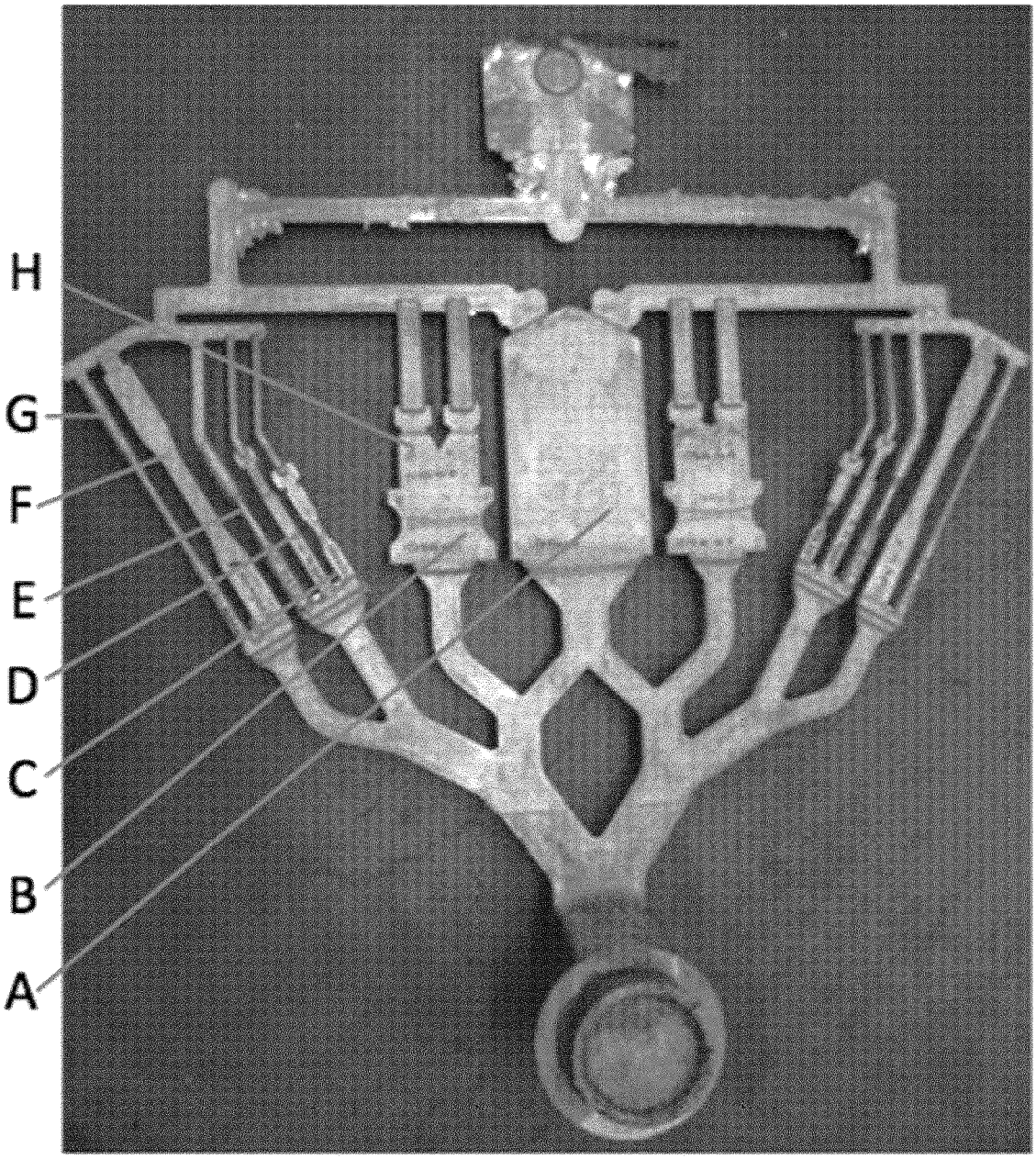
FIG. 10 shows a typical casting of the LSTS component consisting of: A—corrosion plate; B—butterfly shear test specimen; C—standard fatigue test flat specimen; D—standard impact strength test specimen; E—standard fatigue test round specimen; F—standard flat tensile test specimen; G—standard thin tensile test round specimen; H—standard tear test specimen
Figure 11:
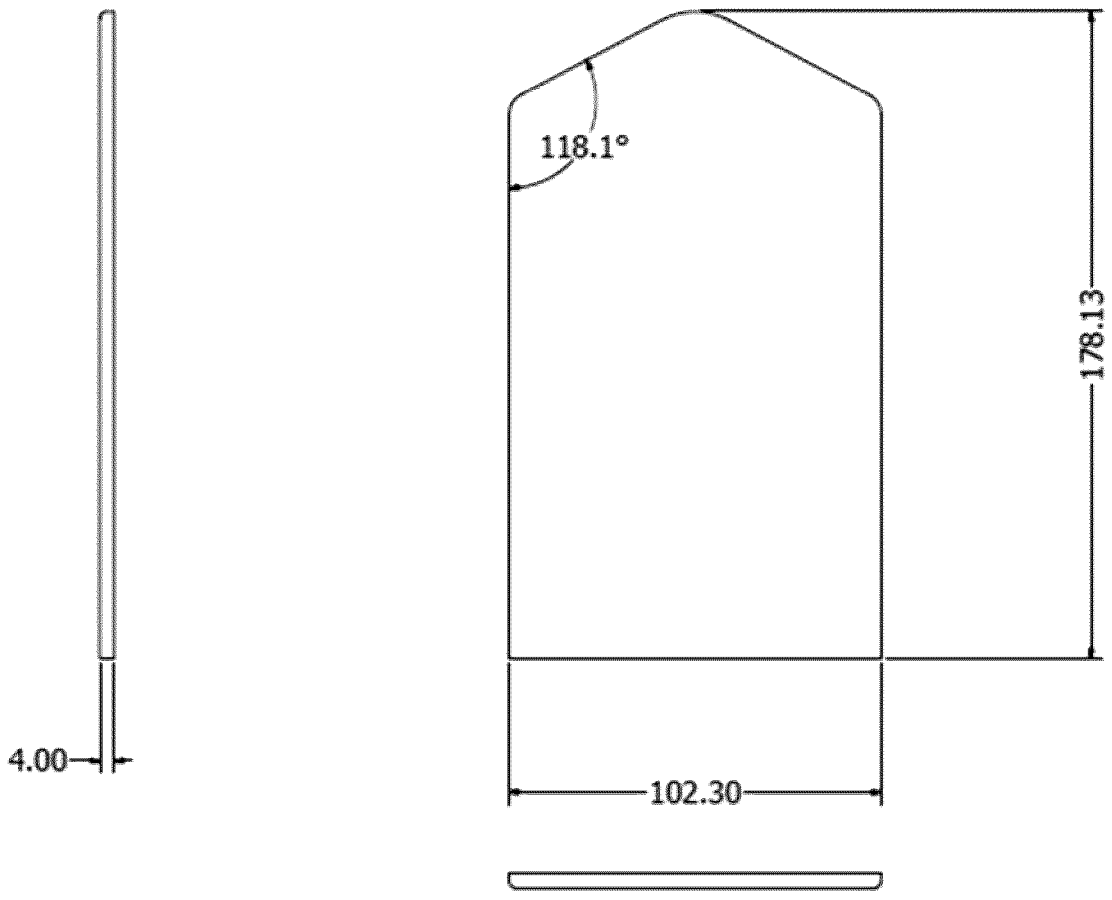
FIG. 11 shows the dimensions in millimeters of the corrosion plate demarcated as A in FIG. 10.
Figure 12:
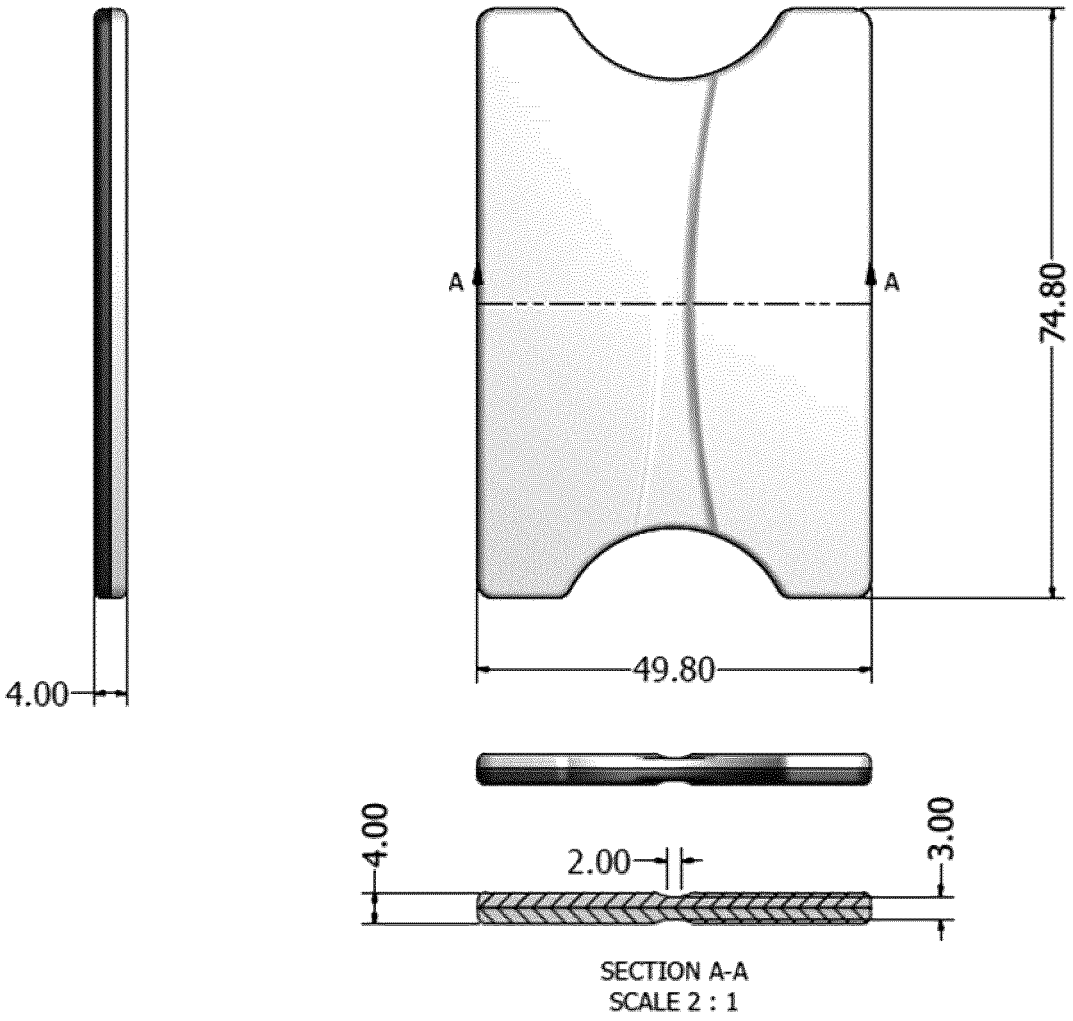
FIG. 12 shows the dimensions in millimeters of the butterfly shear test specimen demarcated as B in FIG. 10.
Figure 13:
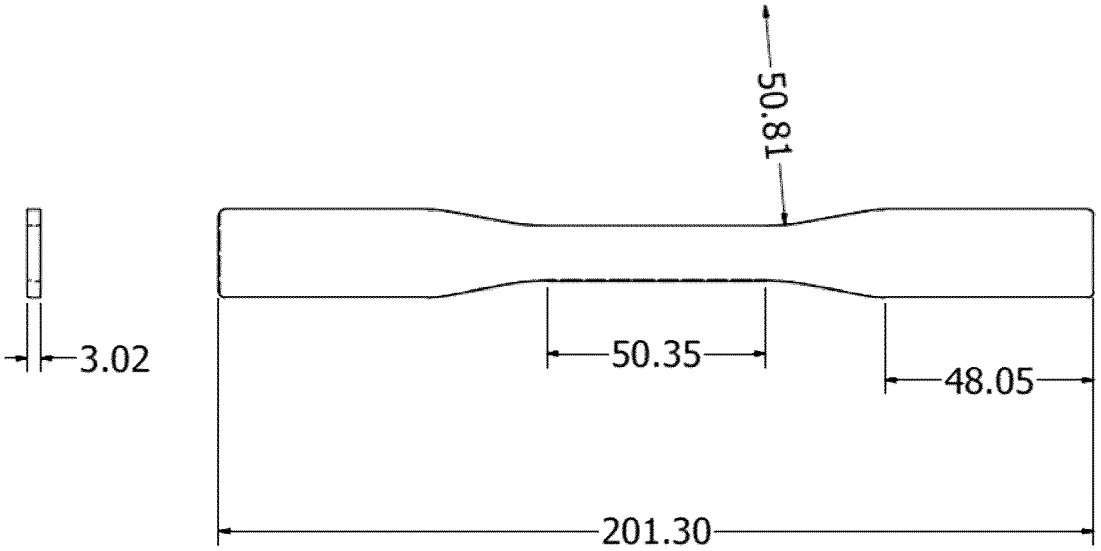
FIG. 13 shows the dimensions in millimeters of the tensile test flat specimen demarcated as F in FIG. 10.
Figure 14:
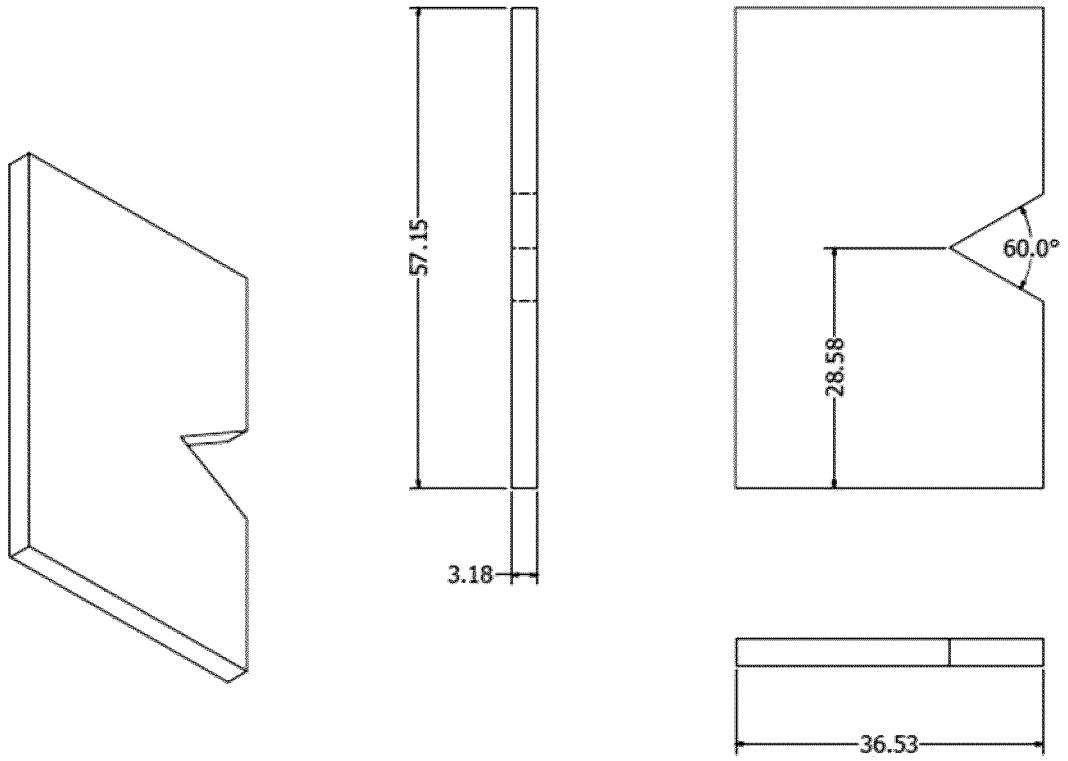
FIG. 14 shows the dimensions in millimeters of the tensile test flat specimen demarcated as H in FIG. 10. The component adheres to the ASTM B871 standard for wear test specimen.

The FIG. 10 shows the photograph of a typical LSTS component. The details of new four (4) types of test specimen in the component shown in FIG. 10 are elaborated in FIG. 11 to FIG. 14.

Casting Process

The Table 6 presents the general details of the casting process used to manufacture the LSTS component shown in FIG. 10.

TABLE 6

| The casting process used to manufacture the LSTS component shown in FIG. 10. | |
|---|---|
| Item | Description |
| Casting Machine | Buhler Carat 105 L High Pressure Die Casting Machine |

TABLE 6-continued

The casting process used to manufacture the LSTS component shown in FIG. 10.

| Item | Description |
|---|---|
| Die Tool material | P20 tool steel. |
| Metal cleanliness | Degassing with Chlorine based tablets |
| Metal temperature | 680° C. to 735° C. |
| Vacuum | Vacuum Assisted |

Heat Treatment

The various heat treatment tempers that the LSTS was subjected to are listed in FIG. 7.

TABLE 7

The various heat treatment that the LSTS components were subjected to after being cast and prior to evaluation of mechanical properties.

| Heat | Description | | | |
|---|---|---|---|---|
| Treatment Temper | Incubation | Solutionizing | Incubation after solutionizing | Artificial high temperature ageing |
| Fx | x day(s) at room temperature | None | N/A | N/A |
| T4-1 | N/A | 460° C. for 3.5 h, water quenched | N/A | N/A |
| T4-2 | N/A | 460° C. for 24 h, water quenched | N/A | N/A |
| T4-3 | N/A | 460° C. for 24 h, air cooled | N/A | N/A |
| T4-4 | N/A | 475° C. for 3.5 h, water quenched | N/A | N/A |
| T4-5 | N/A | 450° C. for 12 h, 5° C./h to 475° C., 475° C. for 7 h, water quenched | N/A | N/A |
| T6 | N/A | 450° C. for 12 h, 5° C./h to 475° C., 475° C. for 7 h, water quenched | 24 h | 120° C. for 24 h, 170° C. for 3 h |
| T7-1 | N/A | 460° C. for 24 h, water quenched | 24 h | 120° C. for 1 h, 170° C. for 6 h |
| T7-2 | N/A | 460° C. for 24 h water quenched | 24 h | 120° C. for 1 h, 160° C. for 20 h |
| T7-3 | N/A | 460° C. for 24 h, water quenched | 24 h | 120° C. for 24 h, 160° C. for 10 h |
| T7-4 | N/A | 460° C. for 24 h, water quenched | 24 h | 120° C. for 24 h, 160° C. for 24 h |
| T7-5 | N/A | 450° C. for 12 h, 5° C./h to 475° C., 475° C. for 7 h, water quenched | 24 h | 120° C. for 24 h, 170° C. for 14 h |
| T7-6 | N/A | 450° C. for 12 h, 5° C./h to 475° C., 475° C. for 7 h, water quenched | 24 h | 120° C. for 24 h, 170° C. for 24 h |

Mechanical Properties

The Table 8 shows the typical mean mechanical properties obtained from uniaxial tensile tests carried out on the LSTS component at various heat treatment tempers.

TABLE 8

The various heat treatment that the LSTS components were subjected to after being cast and prior to evaluation of mechanical properties.

| Alloy | Geometry of the specimen | Heat Treatment Temper | Ultimate Tensile Strength (MPa) | 0.2% Proof Stress (MPa) | Elongation (percentage Increase in gauge length) |
|---|---|---|---|---|---|
| LSTS #1 | Round | $F_{13}$ | 338 | 211 | 5.52 |
| LSTS #1 | Flat | $F_{13}$ | 312 | 201 | 4.63 |
| LSTS #2 | Round | $F_{13}$ | 327 | 218 | 3.95 |
| LSTS #2 | Flat | $F_{13}$ | 303 | 205 | 3.84 |
| LSTS #3 | Round | $F_7$ | 325 | 187 | 8.01 |
| LSTS #4 | Flat | $F_7$ | 293 | 166 | 9.28 |
| LSTS #5 | Flat | $F_7$ | 292 | 162 | 9.71 |
| LSTS #1 | Round | T4-1 | 366 | 230 | 7.13 |
| LSTS #1 | Flat | T4-1 | 340 | 219 | 6.09 |
| LSTS #1 | Round | T4-2 | 353 | 216 | 8.16 |
| LSTS #1 | Flat | T4-2 | 324 | 209 | 6.59 |
| LSTS #2 | Round | T4-1 | 377 | 257 | 5.45 |
| LSTS #2 | Flat | T4-1 | 354 | 247 | 4.81 |
| LSTS #2 | Round | T4-2 | 357 | 238 | 5.45 |
| LSTS #2 | Flat | T4-2 | 372 | 236 | 7.66 |
| LSTS #3 | Flat | T4-1 | 359 | 213 | 8.82 |
| LSTS #3 | Flat | T4-4 | 351 | 209 | 9.13 |
| LSTS #3 | Round | T4-5 | 381 | 214 | 12.59 |
| LSTS #3 | Flat | T4-5 | 372 | 205 | 13.54 |
| LSTS #4 | Flat | T4-4 | 341 | 197 | 10.57 |
| LSTS #4 | Flat | T4-5 | 340 | 188 | 12.10 |
| LSTS #5 | Flat | T4-4 | 334 | 197 | 9.38 |
| LSTS #5 | Flat | T4-5 | 337 | 193 | 11.30 |
| LSTS #3 | Round | T6 | 428 | 375 | 5.30 |
| LSTS #3 | Round | T7-6 | 378 | 312 | 6.16 |
| LSTS #5 | Flat | T7-6 | 343 | 286 | 8.66 |

Figure 15:
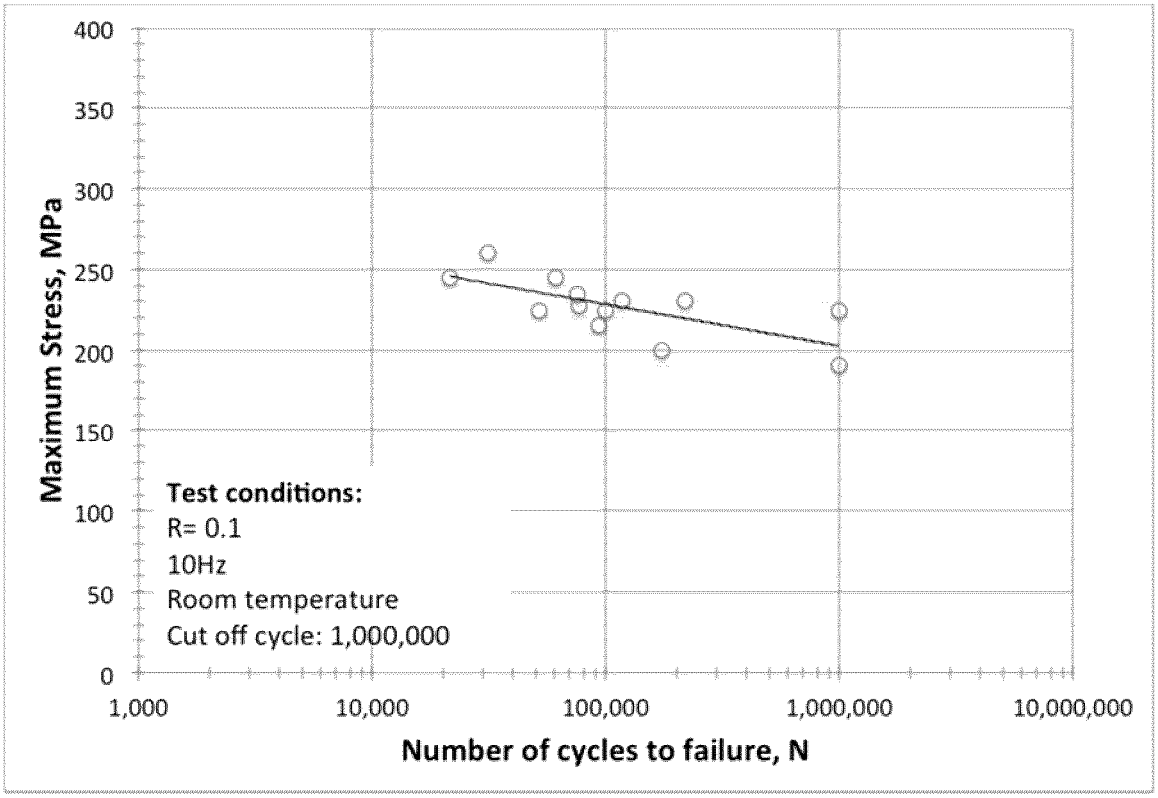
FIG. 15 shows Room temperature S-N curve for smooth round fatigue bar shown in FIG. 10 with alloy LSTS#1 after T7-6 heat treatment.
Figure 16:
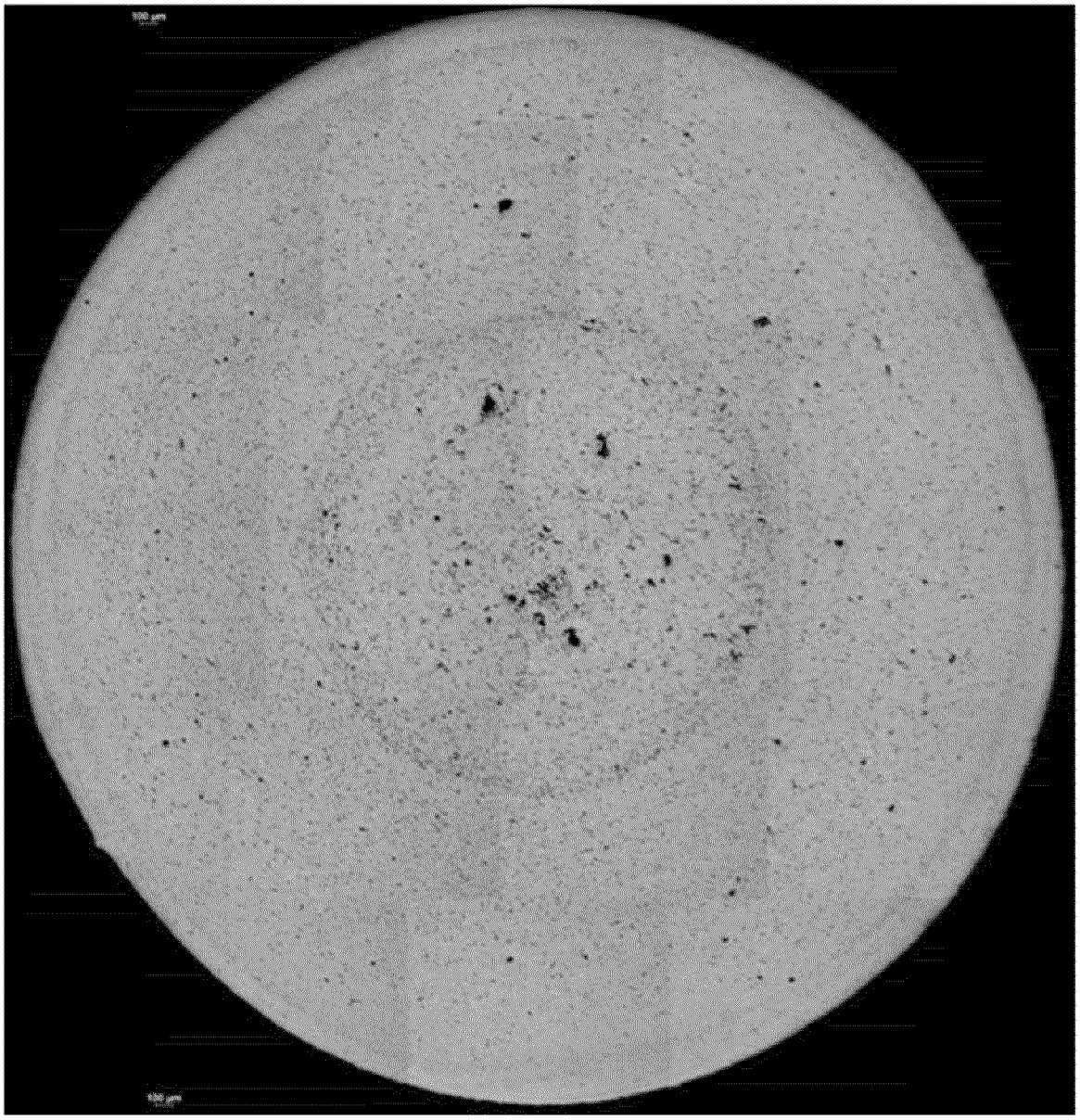
FIG. 16 shows a typical composite microstructure image obtained from a light optical microscope showing the entire cross-section of the gauge section of a round tensile specimen in from the LSTS component. This image is from a specimen in F temper.
Figure 17:
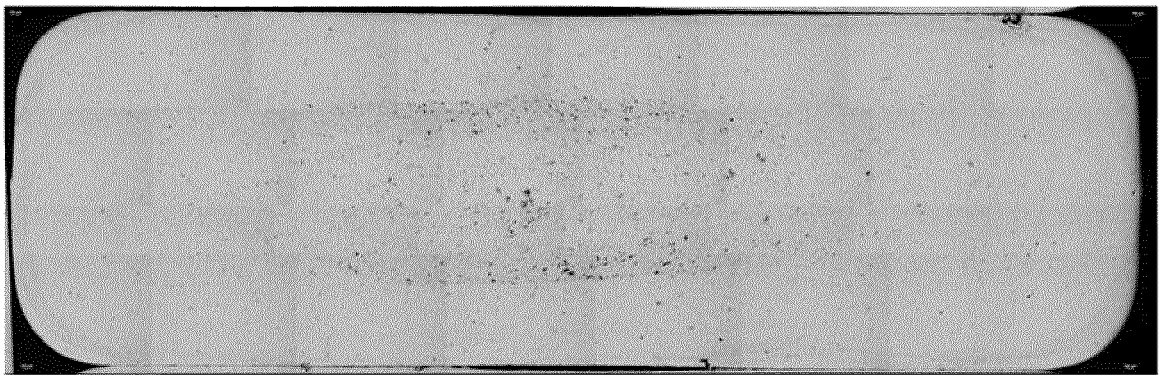
FIG. 17 shows a typical composite microstructure image obtained from a light optical microscope showing the entire cross-section of the gauge section of a flat tensile specimen in from the LSTS component. This image is from a specimen in F temper.
Figure 18:
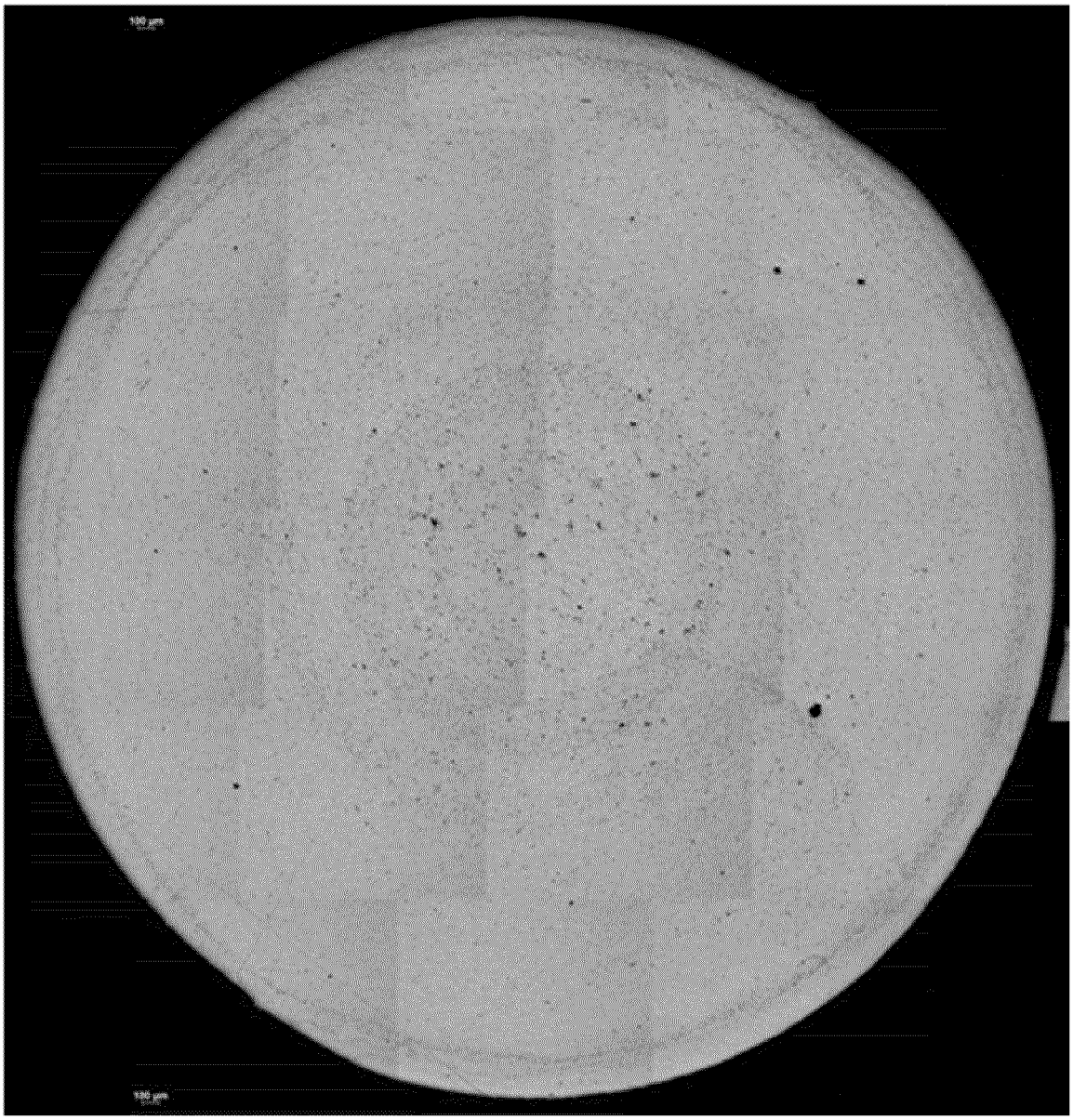
FIG. 18 shows a typical composite microstructure image obtained from a light optical microscope showing the entire cross-section of the gauge section of a round tensile specimen in from the LSTS component. This image is from a specimen in T4 temper.

FIG. 15 shows the room temperature fatigue property of smooth round fatigue bar with alloy LSTS#1 after T7-6 heat treatment.

Microstructure

Typical microstructure images for the LSTS casting are shown for selected alloys in FIG. 16-20.

Salient Features

None of the alloys shown in Table 5 exhibited any die soldering or die sticking tendencies on to the P20 tool steel material of the die.

The P20 tool steel die material did not exhibit any tendencies for heat checking when used with any of the alloys shown in Table 5.

All the castings of LSTS component were of acceptable integrity and quality as per conventional commercial casting industry wisdom; with no observable visual defects, filling issues or mis-runs.

Side Impact Door Beam (SIB)

Alloy Compositions

The following alloy compositions were used in the manufacturing of the side impact door beam (SIB) component.

TABLE 9

The list of typical alloy composition used to cast the SIB component

| Alloy | Zn | Mg | Cu | Fe | Si | Mn | Ti | Sr | Al |
|---|---|---|---|---|---|---|---|---|---|
| | Percentage by Weight | | | | | | | | |
| SIB #1 | 5.0 | 2.0 | 0 | 1.5 | 0 | 0 | 0 | 0 | Bal. |
| SIB #2 | 5.0 | 2.0 | 0.35 | 1.5 | 0 | 0 | 0 | 0 | Bal. |
| SIB #3 (comparative example alloy) | 0.1 | 0.4 | 0.25 | 0.25 | 9.0 | 0.30 | 0.2 | 0.06 | Bal |

Component

Figure 19:
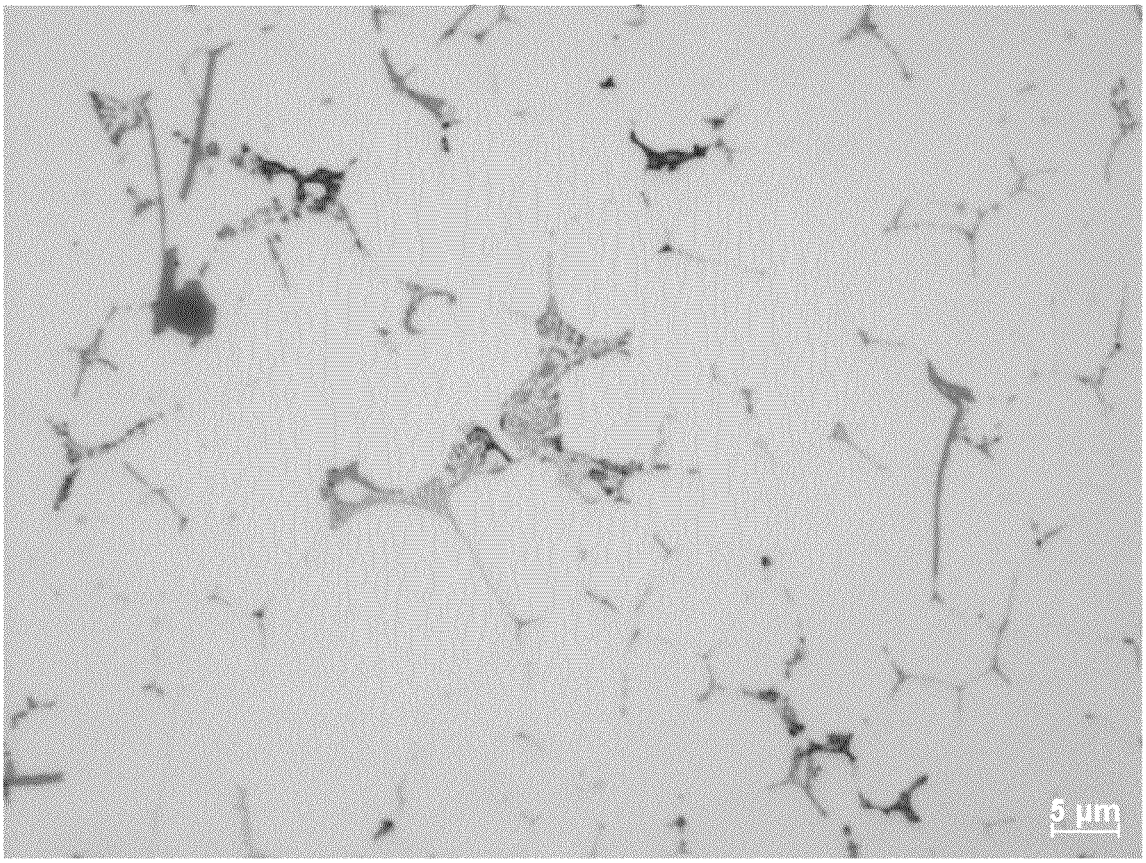
FIG. 19 shows a typical high magnification microstructure image obtained from a light optical microscope showing the primary aluminium phase in light shade and the secondary phases in darker shades. This image is from a round tensile test specimen in F temper.
Figure 20:
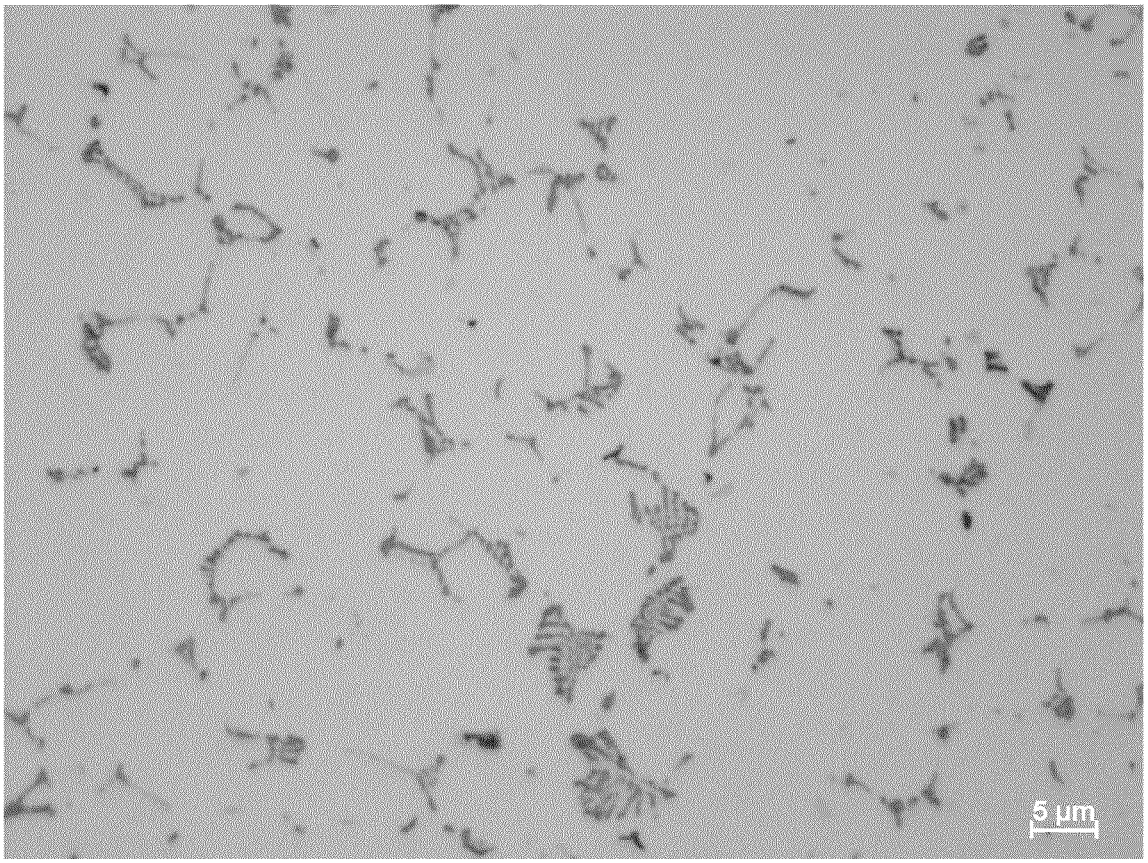
FIG. 20 shows a typical high magnification microstructure image obtained from a light optical microscope showing the primary aluminium phase in lighter shades and the secondary phases in darker shades. This image is from a round tensile test specimen in F temper with alloy LSST#5.
Figure 21:
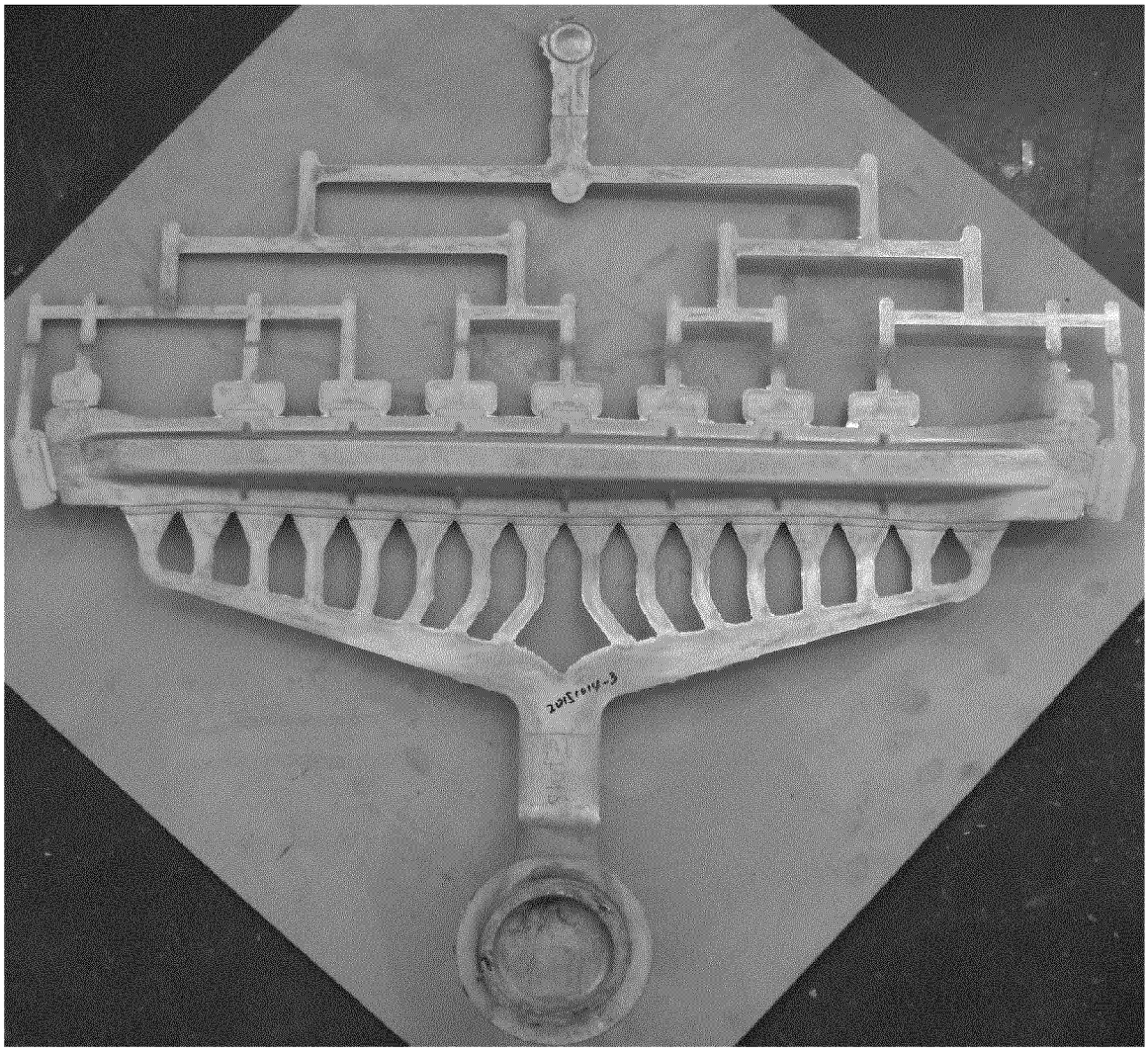
FIG. 21 shows a typical casting of the SIB component.
Figure 22:
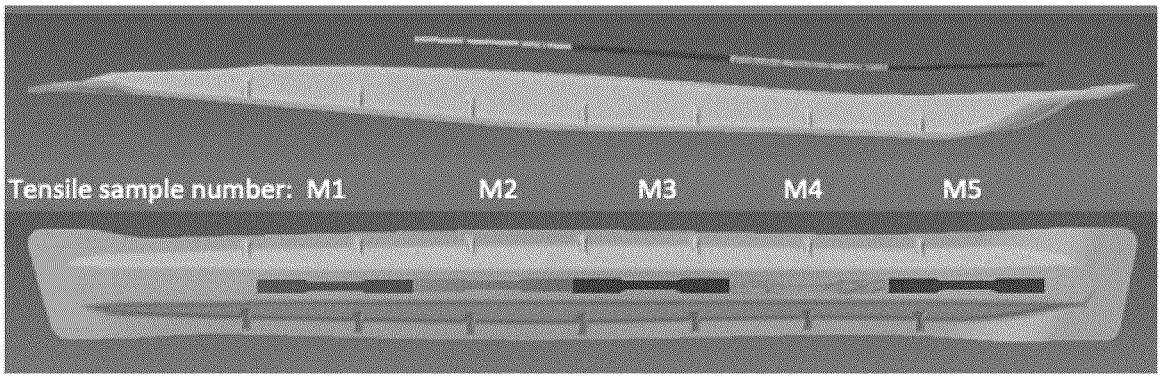
FIG. 22 shows the locations of five (5) tensile test specimens cut and machined from the SIB component.
Figure 23:
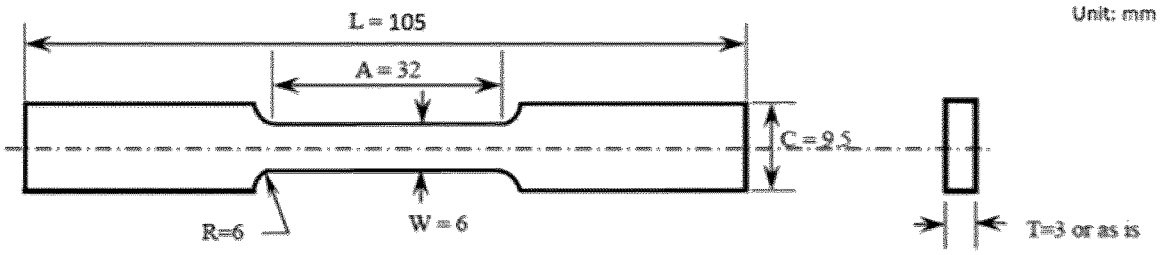
Figure 24:
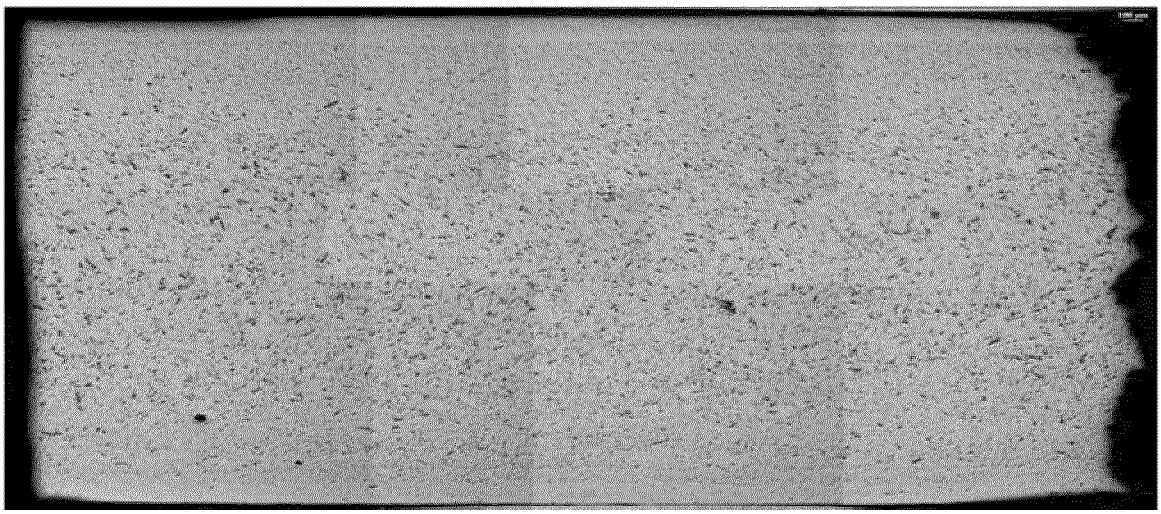
FIG. 24 shows a typical composite microstructure image obtained from a light optical microscope showing the entire cross-section of the gauge section of a flat tensile specimen M5 from the SIB component with alloy SIB#1 and manufactured with vacuum assisted HPDC. This image is from a specimen in F temper.
Figure 25:
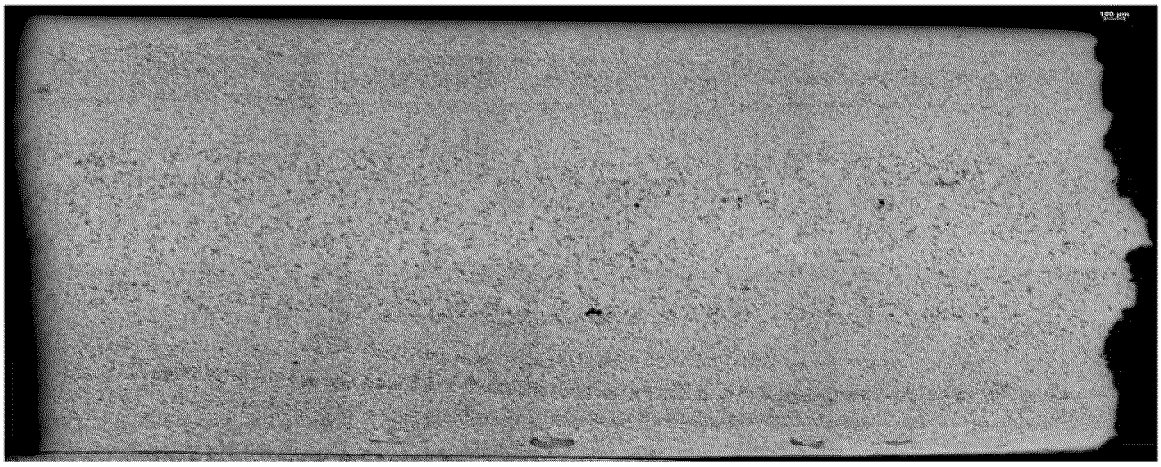
FIG. 25 shows a typical composite microstructure image obtained from a light optical microscope showing the entire cross-section of the gauge section of a flat tensile specimen M5 from the SIB component with alloy SIB#1 and manufactured without vacuum assisted HPDC. This image is from a specimen in F temper.
Figure 26:
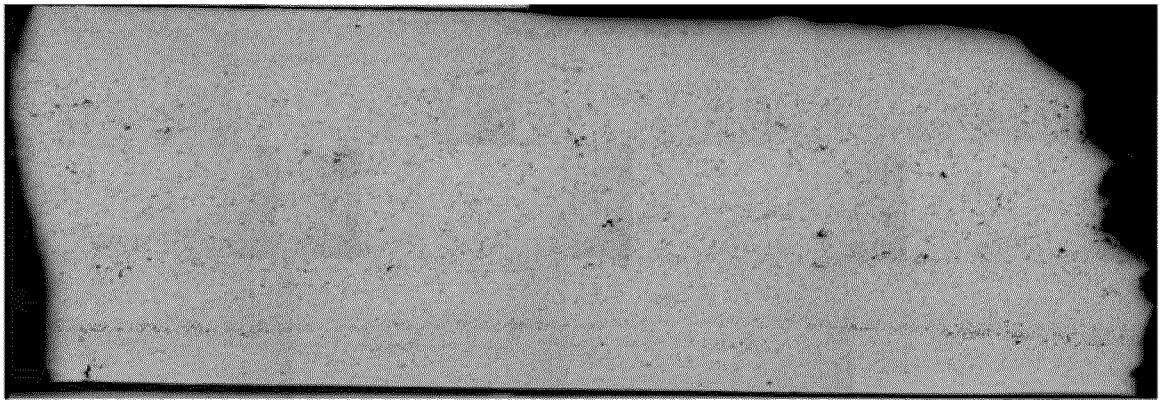
FIG. 26 shows a typical composite microstructure image obtained from a light optical microscope showing the entire cross-section of the gauge section of a flat tensile specimen M5 from the SIB component with alloy SIB#1 and manufactured without vacuum assisted HPDC. This image is from a specimen in T4-3 temper.
Figure 27:
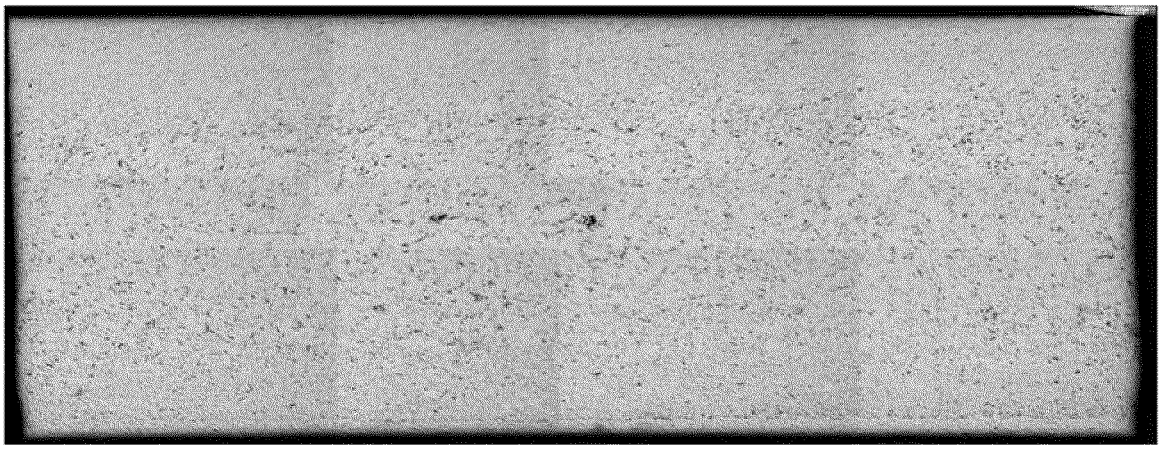
FIG. 27 shows a typical composite microstructure image obtained from a light optical microscope showing the entire cross-section of the gauge section of a flat tensile specimen M3 from the SIB component with alloy SIB#1 and manufactured with vacuum assisted HPDC. This image is from a specimen in T6 temper.

The FIG. 19 shows the photograph of a typical SIB component. The locations of the tensile bars in the SIB component and its dimensions are shown in FIGS. 20 to 21.

Casting Process

The Table 10 presents the general details of the casting process used to manufacture the SIB component shown in Table 19.

TABLE 10

The casting process used to manufacture the SIB component shown in FIG. 19.

| Item | Description |
|---|---|
| Casting Machine 1 | High Pressure Die Casting Machine without vacuum assisted |
| Casting Machine 2 | Buhler Carat 105 L High Pressure Die Casting Machine with vacuum assisted |
| Die Tool material | P20 tool steel |
| Metal cleanliness | Degassing with Nitrogen gas |
| Metal temperature | 680° C. to 735° C. |
| Vacuum | No vacuum with Casting Machine 1<br>Vacuum Assist with Casting Machine 2 |

Heat Treatment

The various heat treatment tempers that the SIB was subjected to are listed in Table 11.

TABLE 11

The various heat treatment that the SIB components were subjected to after being cast and prior to evaluation of mechanical properties.

| Heat | Description | | | |
|---|---|---|---|---|
| Treat-ment Temper | Incubation | Solutionizing | Incubation after solutionizing | Artificial high temperature ageing |
| Fx | x day(s) at room temper-ature | N/A | N/A | N/A |
| T4-1 | N/A | 460° C. for 3.5 h, water quenched | N/A | N/A |
| T4-2 | N/A | 460° C. for 24 h, water quenched | N/A | N/A |
| T4-3 | N/A | 450° C. for 12 h, 5° C./h to 475° C., 475° C. for 7 h, water quenched | N/A | N/A |
| T4-4 | N/A | 450° C. for 22 h, 30° C./h to 500° C., 500° C. for 4 h, water quenched | N/A | N/A |
| T6 | N/A | 450° C. for 12 h, 5° C./h to 475° C., 475° C. for 7 h, water quenched | 24 h | 120° C. for 24 h, 170° C. for 3 h |
| T7-1 | N/A | 450° C. for 12 h, 5° C./h to 475° C., 475° C. for 7 h, water quenched | 24 h | 120° C. for 24 h, 170° C. for 14 h |
| T7-2 | N/A | 450° C. for 12 h, 5° C./h to 457° C., 475° C. for 7 h, water quenched | 24 h | 120° C. for 24 h, 170° C. for 24 h |

Mechanical Properties

The Table 12 shows the typical mean mechanical properties obtained from uniaxial tensile tests carried out on the SIB component at various heat treatment tempers.

TABLE 12

The various heat treatment that the SIB components were subjected to after being cast and prior to evaluation of mechanical properties.

| Alloy | Vacuum assisted | Heat Treatment Temper | Ultimate Tensile Strength (MPa) | 0.2% Proof Stress (MPa) | Elongation (percentage increase in gauge length) |
|---|---|---|---|---|---|
| SIB #1 | No | $F_{21}$ | 315 | 200 | 3.80 |
| SIB #1 | Yes | $F_{14}$ | 304 | 172 | 6.14 |
| SIB #2 | No | $F_{60}$ | 292 | 200 | 3.02 |
| SIB #3 | No | $F_{21}$ | 280 | 146 | 4.59 |
| SIB #1 | No | T4-1 | 326 | 213 | 4.23 |
| SIB #1 | No | T4-2 | 347 | 201 | 8.32 |
| SIB #1 | No | T4-3 | 334 | 211 | 5.70 |
| SIB #1 | Yes | T4-3 | 366 | 216 | 11.21 |
| SIB #1 | No | T4-4 | 350 | 210 | 7.17 |
| SIB #1 | No | T6 | 445 | 394 | 3.15 |
| SIB #1 | Yes | T6 | 457 | 414 | 4.58 |
| SIB #1 | No | T7-1 | 406 | 349 | 5.03 |
| SIB #1 | Yes | T7-2 | 393 | 331 | 6.79 |

Microstructure

Typical microstructure images for the SIB casting for selected alloys are shown in FIGS. 22 to 27.

Salient Features

None of the alloys shown in Table 9 exhibited any die soldering or die sticking tendencies on to the P20 tool steel material of the die.

The P20 tool steel die material did not exhibit any appreciable tendencies for heat checking when used with any of the alloys shown in Table 9.

All the castings of SIB component were of acceptable integrity and quality as per conventional commercial casting industry wisdom; with no observable visual defects, filling issues or mis-runs.

Hot Tear Sensitivity Index (HTS)

Hot tear sensitivity index of Al—Zn—Mg and Al—Zn—Mg—Fe alloys were evaluated with the Constrained Rod Casting (CRC) mould.

Figure 28:
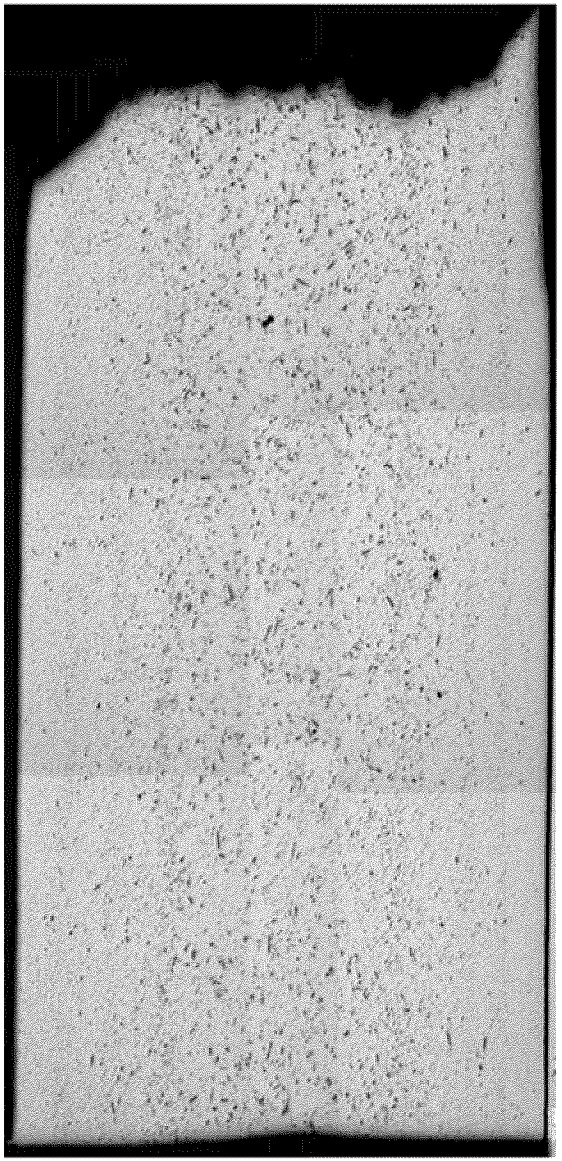
FIG. 28 shows a typical composite microstructure image obtained from a light optical microscope showing the entire cross-section of the gauge section of a flat tensile specimen M5 from the SIB component with alloy SIB#1 and manufactured with vacuum assisted HPDC. This image is from a specimen in T7 temper.

The CRC mould is made of cast iron (FIG. 28), and capable of producing four cylindrical constrained rods with the lengths of 2" (bar A), 3.5" (bar B), 5" (bar C), and 6.5" (bar D) and 0.5" diameter. The bars are constrained at one end by a sprue and at the other end by a spherical riser (feeder) of 0.75" in diameter.

The value of HTS is given by $$HTS = \sum_{i=A}^{D} (C_i \times L_i)$$

Where C is the assigned numerical value for the severity of crack in the bars (Table 13), L is the assigned numerical value corresponding to the length of the bar (Table 14), and represents the bars A, B, C, and D.

TABLE 13

The Numerical Values $C_i$ that Represent Crack Severity

| Categories | Numerical Value ($C_i$) |
|---|---|
| Complete Crack | 4 |
| Severe Crack | 3 |
| Light Crack | 2 |
| Hairline Crack | 1 |
| No Crack | 0 |

TABLE 14

The Numerical Values $L_i$ that Represent Bars of Different Lengths

| Bar Type (length, inch) | Numerical Value ($L_i$) |
|---|---|
| A (2.0) | 1 |
| B (3.5) | 2 |
| C (5.0) | 3 |
| D (6.5) | 4 |

Alloy Compositions

The following alloy compositions were used to evaluate the hot tear sensitivity as listed in Table 15.

TABLE 15

The list of alloy composition used to cast the HTS samples

| Zn | Mg | Fe | Al |
|---|---|---|---|
| Percentage by Weight | | | |
| 5 | 2 | 0 | Bal. |
| 5 | 2 | 0.50 | Bal. |
| 5 | 2 | 0.80 | Bal. |
| 5 | 2 | 1.3 | Bal. |
| 5 | 2 | 1.5 | Bal. |
| 5 | 2 | 2.0 | Bal. |
| 5 | 2 | 2.5 | Bal. |
| 5 | 2 | 3.0 | Bal. |

Casting Process

One kilogram of each alloy in the Table 15 was melted and degassed with high pure Argon gas for 20 minutes. The pouring temperature was kept at 720° C. for all the samples. The CRC mould was preheated at 300° C. before pouring. Each alloy had two hot tear samples.

HTS Results

Figure 29:
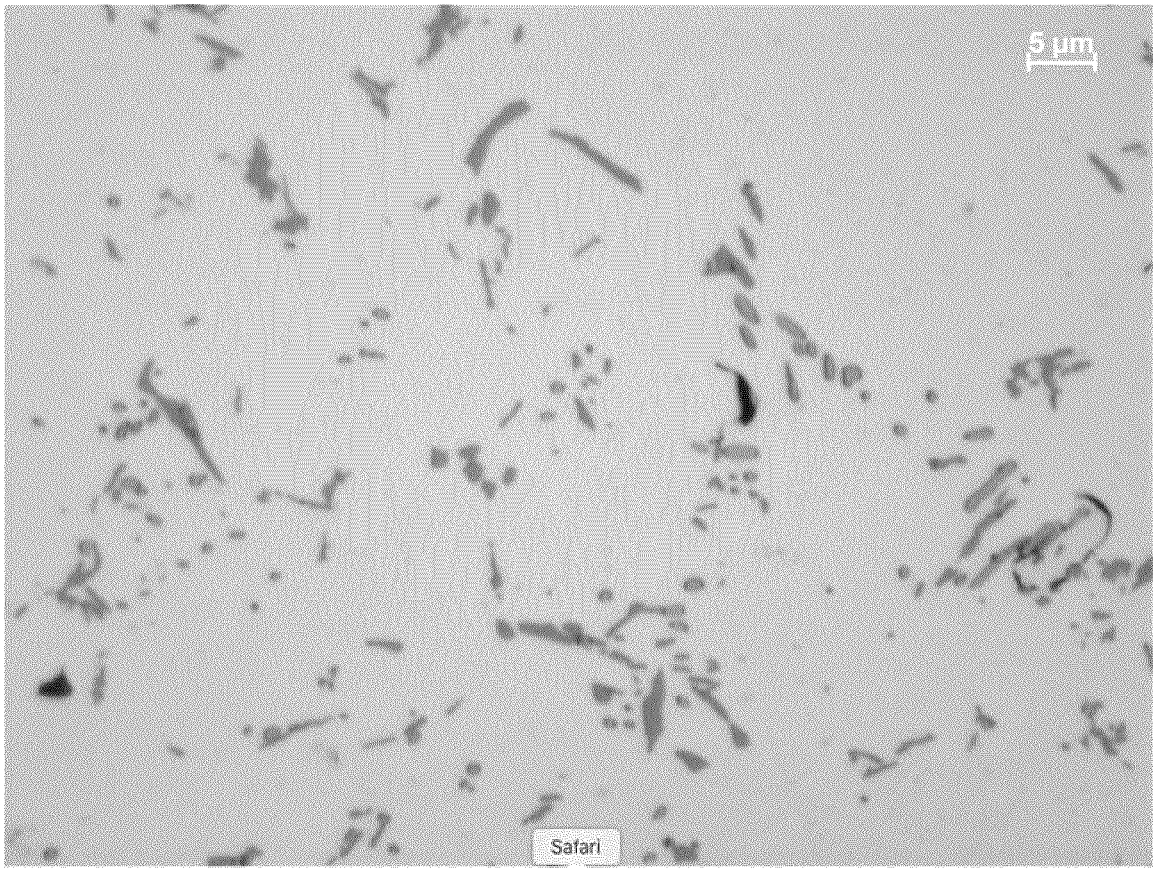
FIG. 29 shows a typical high magnification microstructure image obtained from a light optical microscope showing the primary aluminium phase in light shade and the secondary phases in darker shades.
Figure 30:
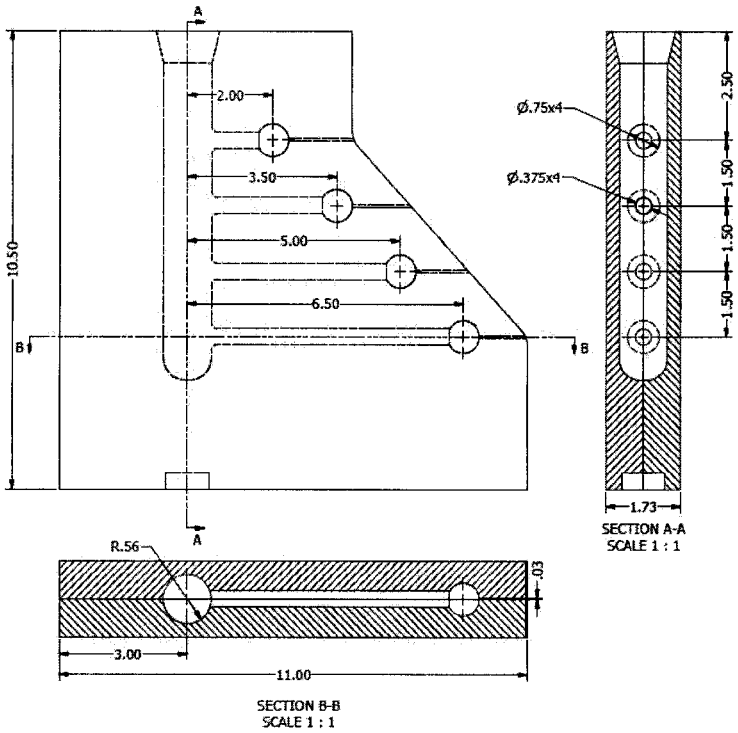
FIG. 30 shows the schematic illustration (dimensions in inches) of the constrained rod casting (CRC) mold.
Figure 31:
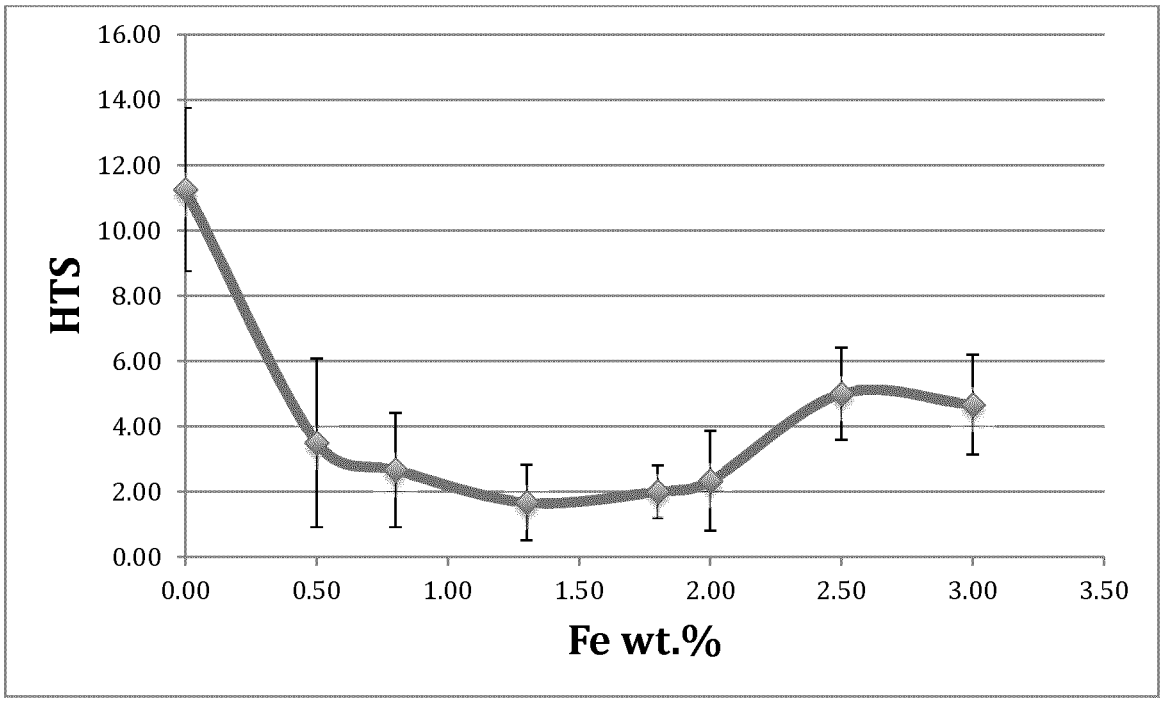
FIG. 31 shows the hot tear sensitivity index of Al-5Zn-2Mg alloys with of various Fe contents.
Figure 32:
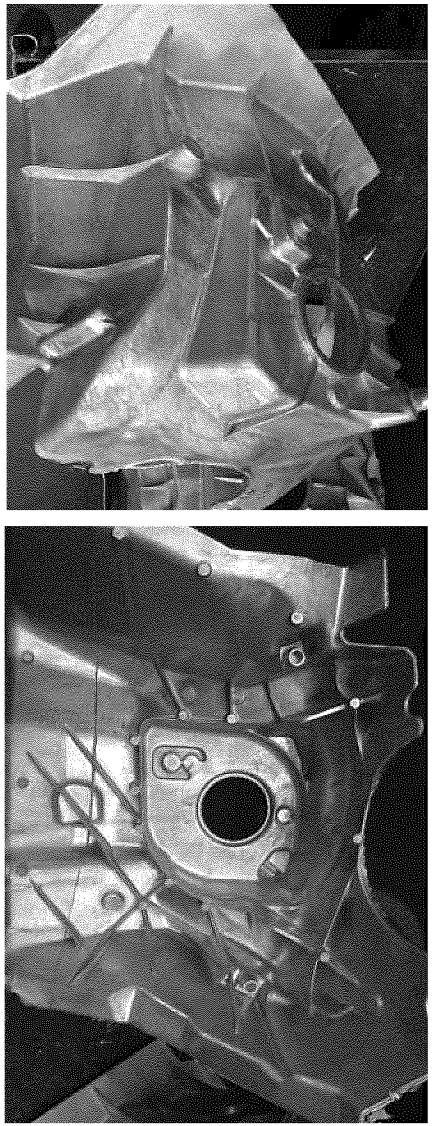
FIG. 32 shows the photographs of the cast component.

As shown in FIG. 29, without Fe addition, Al—Zn—Mg alloy has a high sensitivity to hot tearing. While adding Fe into Al—Zn—Mg, the hot tearing sensitivity of Al—Zn—Mg alloy was alleviated greatly. The HTS index decreases to 1.67 at the addition of 1.3 wt % of Fe.

Pilot Scale Trials

One of the prescribed compositions of the alloy was used to carry out a pilot production scale trial at an automotive casting facility to manufacture a structural component for a car. The alloy composition used was Al-5 wt % Zn-1.6 wt % Mg-1 wt % Fe-0.05 wt % Ti.

The salient details of the casting process are below:

Part: Automotive Shock Tower

Amount of Alloy Melted: 10,000 kg

Melt Temp: 690-730° C.

Degassing: Rotary degasser using industrial purity Ar for 10 minutes

Vacuum System: 3 chill blocks on die

Composition (wt. %): Al-5.0Zn-1.6Mg-1.0Fe-0.05Ti

Number of Crack-free Parts Cast: (not including warm-up shots)

Primary Alloy: 180

50% Remelted Alloy: 80

100% Remelted Alloy: 110

In addition to manufacturing defect free sound castings in a production setting, the other salient advantages from using this new alloy was the significant reduction in die soldering tendencies on the H13 die tool and the 100% re-usability of the alloy composition. The mean uniaxial tensile properties of the as-cast component measured in samples from various locations within each component and obtained from several cast components is:

UTS=263 MPa

YS=145 MPa

% El=8.2%

Notably, the properties did not have any variation among the primary, 50% recycled and 100% recycled initial alloy metal. Further, all the parts were heat treatable to solutionizing temperatures without any discernable blistering. These salient properties and observations enable the use of the new alloy in structural automotive component manufacturing.

Other features and advantages of the present application will become apparent from the following detailed description. It should be understood, however, that the detailed description and the specific examples, while indicating embodiments of the application, are given by way of illustration only and the scope of the claims should not be limited by these embodiments, but should be given the broadest interpretation consistent with the description as a whole.

While the present application has been described with reference to examples, it is to be understood that the scope of the claims should not be limited by the embodiments set forth in the examples, but should be given the broadest interpretation consistent with the description as a whole.

All publications, patents and patent applications are herein incorporated by reference in their entirety to the same extent as if each individual publication, patent or patent application was specifically and individually indicated to be incorporated by reference in its entirety. Where a term in the present application is found to be defined differently in a document incorporated herein by reference, the definition provided herein is to serve as the definition for the term.

Full Citations for Documents Referred to in the Application

ASTM E8/E8M-11a Standard Test Methods for Tension Testing of Metallic Materials, ASTM International, West Conshohocken, Pa., 2011

ASTM E466-15 Standard Practice for Conducting Force Controlled Constant Amplitude Axial Fatigue Tests of Metallic Materials, ASTM International, West Conshohocken, Pa., 2015

ASTM E606/E606M-12 Standard Test Method for Strain-Controlled Fatigue Testing, ASTM International, West Conshohocken, Pa., 2012

ASTM G65-04 Standard Test Method for Measuring Abrasion Using the Dry Sand/Rubber Wheel Apparatus, ASTM International, West Conshohocken, Pa., 2004

ASTM E23-16b Standard Test Methods for Notched Bar Impact Testing of Metallic Materials, ASTM International, West Conshohocken, Pa., 2016

The invention claimed is:

1. An aluminum alloy for High Pressure Die Casting (HPDC) to manufacture near-net shaped components, the aluminum alloy comprising:

from 2 to 10 wt. % zinc (Zn);
from 0.5 to 5 wt. % magnesium (Mg);
from 0.5 to 2 wt. % iron (Fe);
from 0.05 to 0.5 wt. % titanium (Ti);
from 0 to 0.08 wt. % copper (Cu);
from 0 to 0.02 wt. % manganese (Mn); and
balance wt. % aluminum (Al), other elements and impurities,
wherein the other elements are selected from strontium, beryllium, zirconium, vanadium, chromium, scandium, sodium, silicon, nickel, boron, and molybdenum, and
wherein an ultimate tensile strength of the aluminum alloy is from 292 to 457 MPa.

2. The aluminum alloy of claim 1, comprising:
from 4 to 10 wt. % zinc (Zn); and
from 1.5 to 3 wt. % magnesium (Mg).

3. The aluminum alloy of claim 1, comprising:
from 4.5 to 7 wt. % zinc (Zn); and
from 2 to 2.5 wt. % magnesium (Mg).

4. The aluminum alloy of claim 1, comprising:
from 4.74 to 6.86 wt. % zinc (Zn); and
from 2.10 to 2.24 wt. % magnesium (Mg).

5. The aluminum alloy of claim 1, comprising:
0 wt. % silicon (Si);
0 wt. % zirconium (Zr); and
0 wt. % nickel (Ni).

6. The aluminum alloy of claim 1, comprising:
from 0 to 0.1 wt. % strontium (Sr);
from 0 to 0.2 wt. % beryllium (Be);
from 0 to 0.5 wt. % zirconium (Zr);
from 0 to 0.5 wt. % vanadium (V);
from 0 to 0.5 wt. % chromium (Cr);
from 0 to 0.5 wt. % scandium (Sc);
from 0 to 0.1 wt. % sodium (Na);
from 0 to 0.5 wt. % silicon (Si);
from 0 to 5 wt. % nickel (Ni);
from 0 to 0.5 wt. % boron (B); and
from 0 to 1 wt. % molybdenum (Mo).

7. The aluminum alloy of claim 1, comprising from 0.8 to 1.5 wt. % iron (Fe).

8. A component manufactured by the High Pressure Die Casting (HPDC) of the aluminum alloy of claim 1.

9. The component of claim 8, which has been subject to at least one heat treatment selected from incubation at room temperature, solutionizing, incubation after solutionizing, and artificial high temperature aging.

10. The component of claim 8, which has been heat treated by one of:
one step solutionizing at 460° C. for 3.5 hours to 24 hours with cold water quench;
first step solutionizing at 450° C. for 12 to 22 hours, plus ramp up 5 to 30° C. per hour to 475 to 500° C., plus second step solutionizing at 475 to 500° C. for 4 to 7 hours with cold water quench;
incubation between solution and ageing for 1 to 24 hours at room temperature;
one step ageing at 120 to 170° C. for 1 to 24 hours; and
two step ageing at 120° C. for 1 to 24 hours plus 150 to 180° C. for 1 to 24 hours.

11. The aluminum alloy of claim 1, wherein a 0.2% proof stress of the aluminum alloy is from 166 to 414 MPa.

12. The aluminum alloy of claim 1, wherein the ultimate tensile strength of the aluminum alloy is from 328 to 442 MPa, and a 0.2% proof stress of the aluminum alloy is from 197 to 404 MPa.

13. The aluminum alloy of claim 1, wherein the ultimate tensile strength of the aluminum alloy is from 293 to 428 MPa, and a 0.2% proof stress of the aluminum alloy is from 166 to 375 MPa.

14. The aluminum alloy of claim 1, wherein the ultimate tensile strength of the aluminum alloy is from 304 to 457 MPa, and a 0.2% proof stress of the aluminum alloy is from 172 to 414 MPa.

15. The component of claim 8, which has been heat treated by incubation only at room temperature for 7 to 21 days, and wherein the ultimate tensile strength of the aluminum alloy is from 293 to 341 MPa, and a 0.2% proof stress of the aluminum alloy is from 166 to 233 MPa.

16. The component of claim 8, which has been heat treated by one step solutionizing at 460° C. for 3.5 to 24 hours with water quench, and wherein the ultimate tensile strength of the aluminum alloy is from 326 to 394 MPa, and a 0.2% proof stress of the aluminum alloy is from 201 to 238 MPa.

17. The component of claim 8, which has been heat treated by one step solutionizing at 460° C. for 24 hours with water quench, incubation after solutionizing at room temperature for 24 hours, and two step ageing at 120° C. for 2 hours plus 160° C. for 1 to 3 hours, and wherein the ultimate tensile strength of the aluminum alloy is from 412 to 442 MPa, and a 0.2% proof stress of the aluminum alloy is from 348 to 404 MPa.

18. The component of claim 8, which has been heat treated by two step solutionizing at 450° C. for 12 hours plus 5° C./hour to 475° C., 475° C. for 7 hours with water quench, incubation after solutionizing at room temperature for 24 hours, and two step ageing at 120° C. for 24 hours plus 170° C. for 3 to 24 hours, and wherein the ultimate tensile strength of the aluminum alloy is from 378 to 457 MPa, and a 0.2% proof stress of the aluminum alloy is from 312 to 414 MPa.

* * * * *